US007353185B2

(12) United States Patent
Fuyama

(10) Patent No.: US 7,353,185 B2
(45) Date of Patent: Apr. 1, 2008

(54) ELECTRONIC TOLL COLLECTION SYSTEM FOR TOLL ROAD

(75) Inventor: Seiji Fuyama, Yokohama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 976 days.

(21) Appl. No.: 09/864,235

(22) Filed: May 25, 2001

(65) Prior Publication Data

US 2002/0018005 A1 Feb. 14, 2002

(30) Foreign Application Priority Data

May 29, 2000 (JP) ..... 2000-158749

(51) Int. Cl.
*G07B 15/00* (2006.01)

(52) U.S. Cl. ..... 705/13; 340/928; 340/905; 340/933; 340/901; 205/384

(58) Field of Classification Search ..... 705/13, 705/1; 370/449; 340/928, 905, 933, 901; 235/384

See application file for complete search history.

(56) References Cited

U.S. PATENT DOCUMENTS

| | | | | |
|---|---|---|---|---|
| 4,303,904 A | | 12/1981 | Chasek | 235/384 |
| 4,870,419 A | | 9/1989 | Baldwin et al. | 342/50 |
| 5,406,275 A | * | 4/1995 | Hassett et al. | 340/933 |
| 5,640,156 A | * | 6/1997 | Okuda et al. | 340/928 |
| 5,686,906 A | * | 11/1997 | Ono et al. | 340/928 |
| 5,687,175 A | * | 11/1997 | Rochester et al. | 370/449 |
| 5,710,556 A | * | 1/1998 | Nishimura et al. | 340/928 |
| 5,926,546 A | * | 7/1999 | Maeda et al. | 705/65 |
| 5,933,096 A | * | 8/1999 | Tsuda | 340/928 |
| 5,963,149 A | * | 10/1999 | Nagura et al. | 340/933 |
| 6,390,365 B1 | * | 5/2002 | Karasawa | 235/384 |
| 6,570,487 B1 | * | 5/2003 | Steeves | 340/5.2 |
| 6,696,975 B2 | * | 2/2004 | Yamazaki | 340/902 |

FOREIGN PATENT DOCUMENTS

| | | |
|---|---|---|
| CA | 2164031 | 5/1996 |
| JP | 5-30251 | 2/1993 |

OTHER PUBLICATIONS

Jensen, Peter, Tunnel Patrons Experiment with Toll-Paying Device, Nov. 23, 1992, The Sun, Baltimore, Md., p. 1.B.*
Fresco, Robert, The Future is now Series: It Still Ain't EZ. Fourth in a Series, Nov. 27, 1996, Newsday, Long Island, NY., p. A.55.*
Stuckey, Tom, Electronic Toll Collection in Md. Goes to Lockheed, Dec. 4, 1996, The Daily Record, Baltimore, Md., p. 1.*
Automatic Toll Collection System to Debut in 1999, Dec. 17, 1997, The Daily Yomiuri, Tokyo, p. 1.*

* cited by examiner

*Primary Examiner*—John W. Hayes
*Assistant Examiner*—Shannon Saliard
(74) *Attorney, Agent, or Firm*—Louis Woo

(57) ABSTRACT

An ETC system for a toll road includes a road-side device. The road-side device transmitting a polling signal. The road-side device receives a response of an on-vehicle device to the transmitted polling signal. A decision is made as to whether or not the response is received a plural number of times. In cases where it is decided that the response is received a plural number of times, next radio communications with the on-vehicle device are started.

21 Claims, 21 Drawing Sheets

ELECTRONIC TOLL COLLECTION SYSTEM FOR TOLL ROAD

BACKGROUND OF THE INVENTION

1. Field of the Invention

This invention relates to an electronic toll collection system (an ETC system) for a toll road. In addition, this invention relates to a method in an ETC system for a toll road. Furthermore, this invention relates to an on-vehicle device in an ETC system for a toll road.

1. Description of the Related Art

In an ETC system for a toll road, when every ETC vehicle passes through a tollgate, an accounting machine in the tollgate and the ETC vehicle communicate with each other by wireless to automatically implement an accounting process. Accordingly, it is unnecessary for the ETC vehicle to pause at the tollgate to pay toll. The ETC vehicle means a vehicle designed for the ETC system. Generally, it is desirable to stabilize wireless communications between the ETC vehicle and the accounting machine in the tollgate.

The ETC system can not automatically implement an accounting process with respect to a non-ETC vehicle. The non-ETC vehicle means a vehicle not adapted to the ETC system. It is necessary for the tollgate in the ETC system to discriminate non-ETC vehicles from ETC vehicles, and to guide the non-ETC vehicles to a booth where toll can be manually paid or to urge the drivers of the non-ETC vehicles to manually pay toll. It is desirable to provide a high accuracy of discrimination of non-ETC vehicles from ETC vehicles.

SUMMARY OF THE INVENTION

It is a first object of this invention to provide an electronic toll collection system (an ETC system) for a toll road which is able to provide stable wireless communications between an ETC vehicle and a tollgate.

It is a second object of this invention to provide an improved method in an ETC system for a toll road.

It is a third object of this invention to provide an improved on-vehicle device in an ETC system for a toll road.

A first aspect of this invention provides an ETC system for a toll road. The ETC system comprises a road-side device; first means provided in the road-side device for transmitting a polling signal; second means provided in the road-side device for receiving a response of an on-vehicle device to the polling signal transmitted by the first means; third means provided in the road-side device for deciding whether or not the second means receives the response a plural number of times; and fourth means provided in the road-side device for starting next radio communications with the on-vehicle device in cases where the third means decides that the second means receives the response a plural number of times.

A second aspect of this invention provides an ETC system for a toll road. The ETC system comprises a first vehicle sensor for detecting a vehicle at a first position on a lane; a second vehicle sensor for detecting a vehicle at a second position on the lane which is adjacently ahead of the first position; first means for transmitting a polling signal when the first vehicle sensor detects a vehicle; second means for receiving a response of an on-vehicle device to the polling signal transmitted by the first means; and third means for, after the second means receives the response, starting next radio communications with the on-vehicle device in cases where both the first and second vehicle sensors detect a vehicle.

A third aspect of this invention is based on the second aspect thereof, and provides an ETC system wherein the second vehicle sensor is spaced from the first vehicle sensor at an interval of about 80 cm.

A fourth aspect of this invention provides an ETC system for a toll road. The ETC system comprises a road-side device; first means provided in the road-side device for implementing communications with an on-vehicle device; second means provided in the road-side device for measuring a lapse of time from a moment at which the first means starts implementing the communications with the on-vehicle device; third means provided in the road-side device for deciding whether or not the lapse of time which is measured by the second means reaches a prescribed time interval; and fourth means provided in the road-side device for maintaining the communications with the on-vehicle device which are implemented by the first means in cases where the third means decides that the lapse of time does not reach the prescribed time interval, and terminating the communications with the on-vehicle device after the third means decides that the lapse of time reaches the prescribed time interval.

A fifth aspect of this invention provides an ETC system for a toll road. The ETC system comprises an on-vehicle device; first means provided in the on-vehicle device for receiving data from a road-side device; second means provided in the on-vehicle device for receiving a communication end signal from the road-side device after the first means receives the data therefrom; and third means provided in the on-vehicle device for handling the data received by the first means as effective data regardless of whether or not the second means successfully receives the communication end signal.

A sixth aspect of this invention is based on the fifth aspect thereof, and provides an ETC system further comprising means provided in the road-side device for transmitting the communication end signal a plural number of times.

A seventh aspect of this invention provides an ETC system for a toll road. The ETC system comprises a road-side device; first means provided in the road-side device for receiving data from an on-vehicle device; second means provided in the road-side device for receiving a communication end signal from the on-vehicle device after the first means receives the data therefrom; and third means provided in the road-side device for handling the data received by the first means as effective data regardless of whether or not the second means successfully receives the communication end signal.

An eighth aspect of this invention is based on the seventh aspect thereof, and provides an ETC system further comprising means provided in the on-vehicle side device for transmitting the communication end signal a plural number of times.

A ninth aspect of this invention provides an ETC system for a toll road. The ETC system comprises a first road-side antenna for providing a first radio-communication service area; first means for implementing radio communications with an on-vehicle device via the first road-side antenna; a second road-side antenna for providing a second radio-communication service area different from the first radio-communication service area; second means for implementing radio communications with an on-vehicle device via the second road-side antenna; and third means for controlling the first means and the second means to execute the radio communications via the first road-side antenna and the radio communications via the second road-side antenna in a way selected from plural ways including a time sharing way.

A tenth aspect of this invention is based on the ninth aspect thereof, and provides an ETC system wherein the plural ways includes a frequency division way in which a frequency of a radio signal used in the radio communications via the first road-side antenna differs from a frequency of a radio signal used in the radio communications via the second road-side antenna.

An eleventh aspect of this invention provides an ETC system for a toll road. The ETC system comprises a first road-side antenna for providing a first radio-communication service area; first means for implementing radio communications with an on-vehicle device via the first road-side antenna; a second road-side antenna for providing a second radio-communication service area different from the first radio-communication service area; second means for implementing radio communications with an on-vehicle device via the second road-side antenna; third means for writing information related to the first road-side antenna into a memory within an on-vehicle device through the radio communications implemented by the first means; fourth means for accessing a memory within an on-vehicle device through the radio communications implemented by the second means, and deciding whether or not the information related to the first road-side antenna is in the accessed memory; and fifth means for halting the radio communications implemented by the second means when the fourth means decides that the information related to the first road-side antenna is not in the accessed memory.

A twelfth aspect of this invention is based on the eleventh aspect thereof, and provides an ETC system further comprising sixth means for preventing reflection of a radio wave with respect to first radio-communication service area.

A thirteenth aspect of this invention provides a method in an ETC system for a toll road. The method comprises the steps of transmitting a polling signal from a road-side device; enabling the road-side device to receive a response of an on-vehicle device to the polling signal; deciding whether or not the road-side device receives the response a plural number of times; and enabling the road-side device to start next radio communications with the on-vehicle device in cases where it is decided that the road-side device receives the response a plural number of times.

A fourteenth aspect of this invention provides a method in an ETC system for a toll road. The method comprises the steps of detecting a vehicle is at a first position on a lane; detecting a vehicle at a second position on the lane which is adjacently ahead of the first position; transmitting a polling signal when a vehicle at the first position is detected; receiving a response of an on-vehicle device to the polling signal; and after the response is received, starting next radio communications with the on-vehicle device in cases where both a vehicle at the first position and a vehicle at the second position are detected.

A fifteenth aspect of this invention provides a method in an ETC system for a toll road. The method comprises the steps of enabling a road-side device to implement communications with an on-vehicle device; measuring a lapse of time from a moment at which implementing the communications with the on-vehicle device is started; deciding whether or not the measured lapse of time reaches a prescribed time interval; and maintaining the communications with the on-vehicle device in cases where it is decided that the measured lapse of time does not reach the prescribed time interval, and terminating the communications with the on-vehicle device after it is decided that the measured lapse of time reaches the prescribed time interval.

A sixteenth aspect of this invention provides a method in an ETC system for a toll road. The method comprises the steps of receiving data from an on-vehicle device; receiving a communication end signal from the on-vehicle device after the data are received therefrom; and handling the received data as effective data regardless of whether or not the communication end signal is successfully received.

A seventeenth aspect of this invention provides an on-vehicle device in an ETC system for a toll road. The on-vehicle device comprises first means for receiving data from a road-side device; second means for receiving a communication end signal from the road-side device after the first means receives the data therefrom; and third means for handling the data received by the first means as effective data regardless of whether or not the second means successfully receives the communication end signal.

DETAILED DESCRIPTION OF THE INVENTION

Prior-art ETC systems for toll roads will be explained below for a better understanding of this invention.

Figure 1:
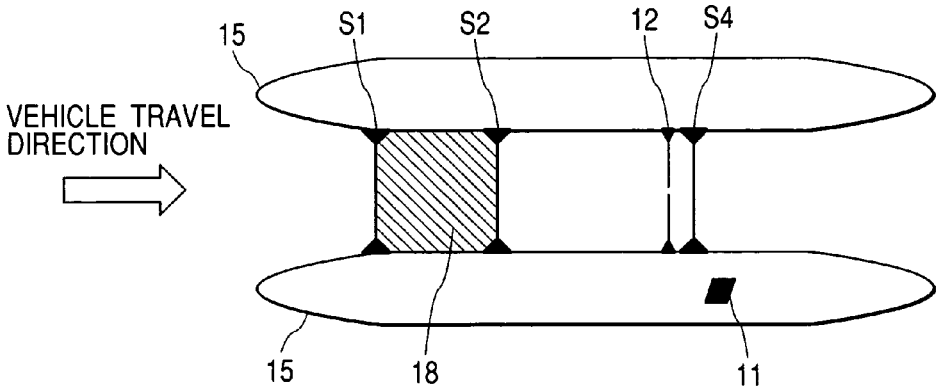
FIG. 1 PRIOR ART
FIG. 1 is a plan view of a tollgate in a first prior-art ETC system.
Figure 2:
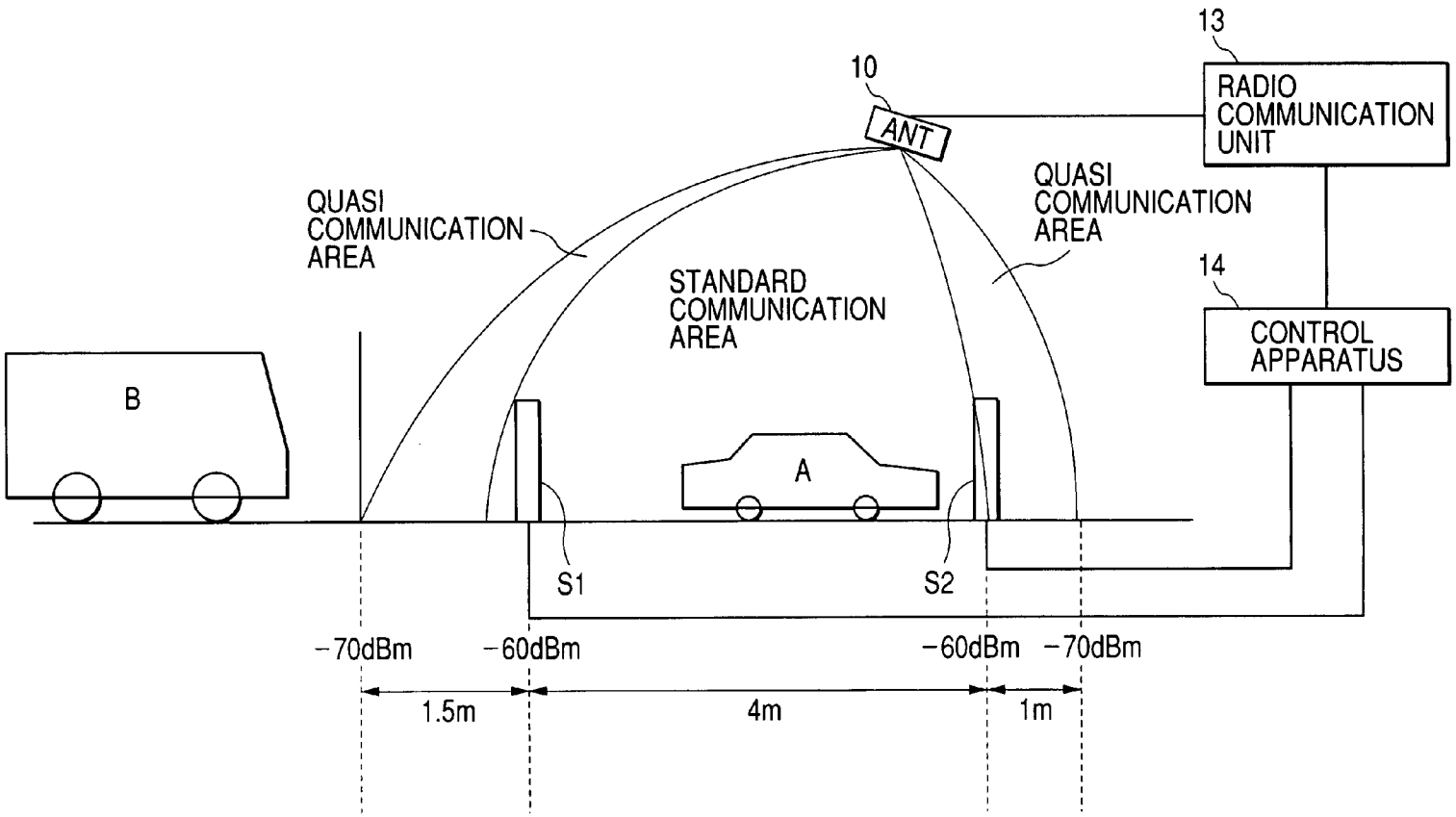
FIG. 2 PRIOR ART
FIG. 2 is a side view of the tollgate in FIG. 1.

FIGS. 1 and 2 show a tollgate in a first prior-art ETC system. As shown in FIGS. 1 and 2, the tollgate includes a road-side antenna 10, a road-side indicator 11, a drive machine 12, a road-side radio communication unit 13, a control apparatus 14, and vehicle sensors S1, S2, and S4.

The road-side antenna 10 is located above a lane. The road-side antenna 10 is connected to the road-side radio communication unit 13. The load-side indicator 11 is located on an island 15 extending along a side of the lane. The drive machine 12 is connected to a gate member associated with the lane. The drive machine 12 moves the gate member between an open position and a closed position. The control apparatus 14 is connected to the road-side indicator 11, the drive machine 12, the road-side radio communication unit 13, and the vehicle sensors S1, S2, and S4.

The vehicle sensors S1, S2, and S4 are sequentially arranged along the lane in a vehicle forward direction. The vehicle sensor S4 is ahead of the gate member connected with the drive machine 12.

Each of the vehicle sensors S1, S2, and S4 includes a photo-transmitter and a photo-receiver which are located at the opposite sides of the lane, respectively. The photo-transmitter emits a light beam toward the photo-receiver along an optical path perpendicular to the lane. The light beam does not reach the photo-receiver when a vehicle blocks the optical path. The light beam reaches the photo-receiver in the absence of a vehicle from the optical path. The photo-receiver converts the presence and the absence of the received light beam into an electric signal representing whether or not a vehicle is in a lane position corresponding to the position of the vehicle sensor. The photo-receiver outputs the electric signal to the control apparatus 14 as an output signal of the vehicle sensor.

The road-side radio communication unit 13 is controlled by the control apparatus 14, feeding a radio signal to the road-side antenna 10. The road-side antenna 10 radiates the radio signal toward the lane as a downward radio signal. Every ETC vehicle has an on-vehicle device including a combination of an antenna and a radio communication unit. The on-vehicle device can receive the downward radio signal. The on-vehicle device can transmit an upward radio signal. The upward radio signal is received by the road-side antenna 10. The received radio signal is fed from the road-side antenna 10 to the road-side radio communication unit 13. The road-side radio communication unit 13 derives information from the received radio signal. The road-side radio communication unit 13 outputs a signal representative of the derived information to the control apparatus 14.

The control apparatus 14 decides whether a vehicle "A" in question is of an ETC type or a non-ETC type, and whether the vehicle "A" should be permitted to pass or be inhibited from passing on the basis of the output signals from the vehicle sensors S1, S2, and S4 and the road-side radio communication unit 13. In addition, the control apparatus 14 controls the road-side indicator 11 and the drive machine 12 on the basis of the output signals from the vehicle sensors S1, S2, and S4 and the road-side radio communication unit 13. Specifically, when it is decided that the vehicle "A" should be permitted to pass, the road-side indicator 11 is controlled to display "go ahead" to the vehicle "A". At the same time, the drive machine 12 is controlled to open the gate member. When it is decided that the vehicle "A" should be inhibited from passing, the road-side indicator 11 is controlled to display "stop" to the vehicle "A". At the same time, the drive machine 12 is controlled to maintain the gate member at its closed position or to move the gate member to its closed position.

The interval between the vehicle sensors S1 and S2 is set to about 4 m. The road-side antenna 10 provides a radio-communication service area 18. The directivity of the road-side antenna 10 is designed so that the related radio-communication service area 18 will be limited to the range of the lane between the vehicle sensors S1 and S2.

An incoming vehicle traveling along the lane is successively detected by the vehicle sensors S1, S2, and S4. When the vehicle sensor S1 detects the front of the present vehicle, the vehicle sensor S1 informs the control apparatus 14 of the vehicle-front detection. The control apparatus 14 starts the road-side radio communication unit 13 in response to the information of the vehicle-front detection so that the road-side radio communication unit 13 feeds a radio signal to the road-side antenna 10. The road-side antenna 10 radiates the radio signal into the radio-communication service area 18 as a downward radio signal.

In the case where the present vehicle is of the ETC type, the on-vehicle device thereon transmits an upward radio signal in response to the downward radio signal. The upward radio signal (the response radio signal) is received by the road-side antenna 10. The received radio signal is fed from the road-side antenna 10 to the road-side radio communication unit 13. In this way, the road-side radio communication unit 13 receives the response radio signal. The response reception causes subsequent radio communications to be carried out between the road-side radio communication unit 13 and the on-vehicle device of the present vehicle. The road-side radio communication unit 13 informs the control apparatus 14 of the response reception. The control apparatus 14 decides the present vehicle to be of the ETC type on the basis of the information of the response reception, and automatically implements an accounting process. In addition, the control apparatus 14 drives the road-side indicator 11 to display "go ahead". Furthermore, the control apparatus 14 commands the drive machine 12 to open the gate member.

When the vehicle sensor S2 detects the front of the present vehicle, the vehicle sensor S2 informs the control apparatus 14 of the vehicle-front detection. The control apparatus 14 deactivates the road-side radio communication unit 13 in response to the information of the vehicle-front detection, thereby terminating radio communications between the road-side radio communication unit 13 and the on-vehicle device of the present vehicle.

When the vehicle sensor S4 detects the tail of the present vehicle, the vehicle sensor S4 informs the control apparatus 14 of the vehicle-tail detection. The control apparatus 14 commands the drive machine 12 in response to the information of the vehicle-tail detection to close the gate member.

In the case where the present vehicle which has been detected by the vehicle sensor S1 is of the non-ETC type, the present vehicle does not transmit any upward radio signal in response to the downward radio signal. Therefore, the control apparatus 14 is informed of the absence of the response.

When the vehicle sensor S2 detects the front of the present vehicle, the vehicle sensor S2 informs the control apparatus 14 of the vehicle-front detection. The control apparatus 14 decides the present vehicle to be of the non-ETC type provided that the response remains absent until the vehicle-front detection is notified from the vehicle sensor S2. In this case, the control apparatus 14 deactivates the road-side radio communication unit 13 to interrupt the transmission of the radio signal. In addition, the control apparatus 14 drives the road-side indicator 11 to display "stop". After the present vehicle completes paying toll, the control apparatus 14 commands the drive machine 12 to open the gate member.

Figure 3:
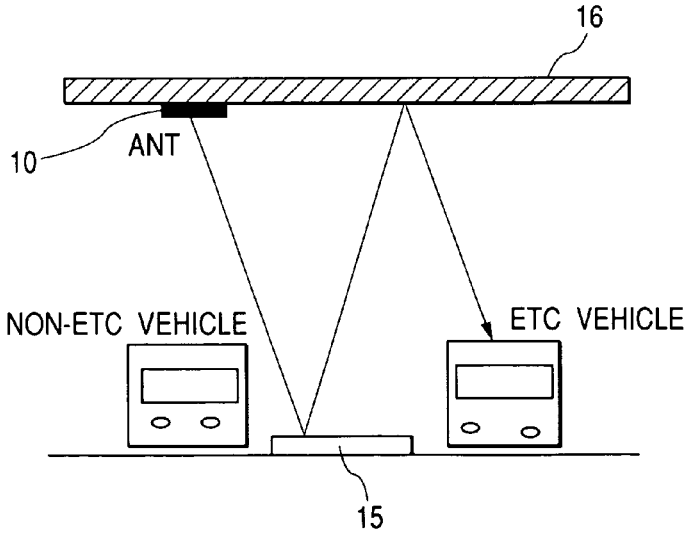
FIG. 3 PRIOR ART
FIG. 3 is a front view of a portion of the tollgate in FIGS. 1 and 2.

The first prior-art ETC system (see FIGS. 1 and 2) has problems indicated below. As shown in FIG. 3, the tollgate has constructions such as a roof 16 and a gantry (not shown). A consideration is given of the case where a non-ETC vehicle is in the present lane below the road-side antenna 10 while an ETC vehicle is in a lane adjacent to the present lane. As shown in FIG. 3, there is a chance that radio wave is propagated from the road-side antenna 10 to the ETC vehicle after being reflected by the roof 16 and the island 15. When radio communications are successfully implemented between the road-side radio communication unit 13 (see FIG. 2) and the on-vehicle device of the ETC vehicle, the control apparatus 14 (see FIG. 2) erroneously decides that the non-ETC vehicle in the present lane is of the ETC type.

According to the prescription, every on-vehicle device is required to transmit a response radio signal when the strength of the electric field of received radio wave is equal to or greater than −60 dBm, and not to transmit any response radio signal when the electric field strength is equal to or smaller than −70 dBm. Therefore, every on-vehicle device is designed to start radio communications with a tollgate when the strength of the electric field of received radio wave is equal to a value between −60 dBm and −70 dBm.

With reference to FIG. 2, the tollgate is designed in accordance with the prescription so that the strength of the electric field of radio wave radiated by the road-side antenna 10 will be equal to or greater than −60 dBm only in the radio-communication service area (the standard radio-communication service area) 18 over the lane between the vehicle sensors S1 and S2. Around the standard radio-communication service area 18, there is a quasi radio-communication service area in which the strength of the electric field of radio wave radiated by the road-side antenna 10 is between −60 dBm and −70 dBm. Some of on-vehicle devices in the quasi radio-communication service area can communicate with the tollgate by radio, while the others can not. Reflection of radio wave by the roof 16 and the island 15 (see FIG. 3) may cause an on-vehicle device in the quasi radio-communication service area to be capable of communicating with the tollgate by radio. In an outer portion of the standard radio-communication service area, interference between radio waves may decrease the electric-field strength below −70 dBm.

The road-side antenna 10 starts radiating a downward radio signal when the vehicle sensor S1 detects the front of an incoming vehicle. In the case where the incoming vehicle travels at a low speed or has a long nose and an on-vehicle device is mounted on a dashboard of the vehicle, the on-vehicle device may not reach the standard radio-communication service area at a moment when a polling stage of radio communications should be executed.

Figure 4:
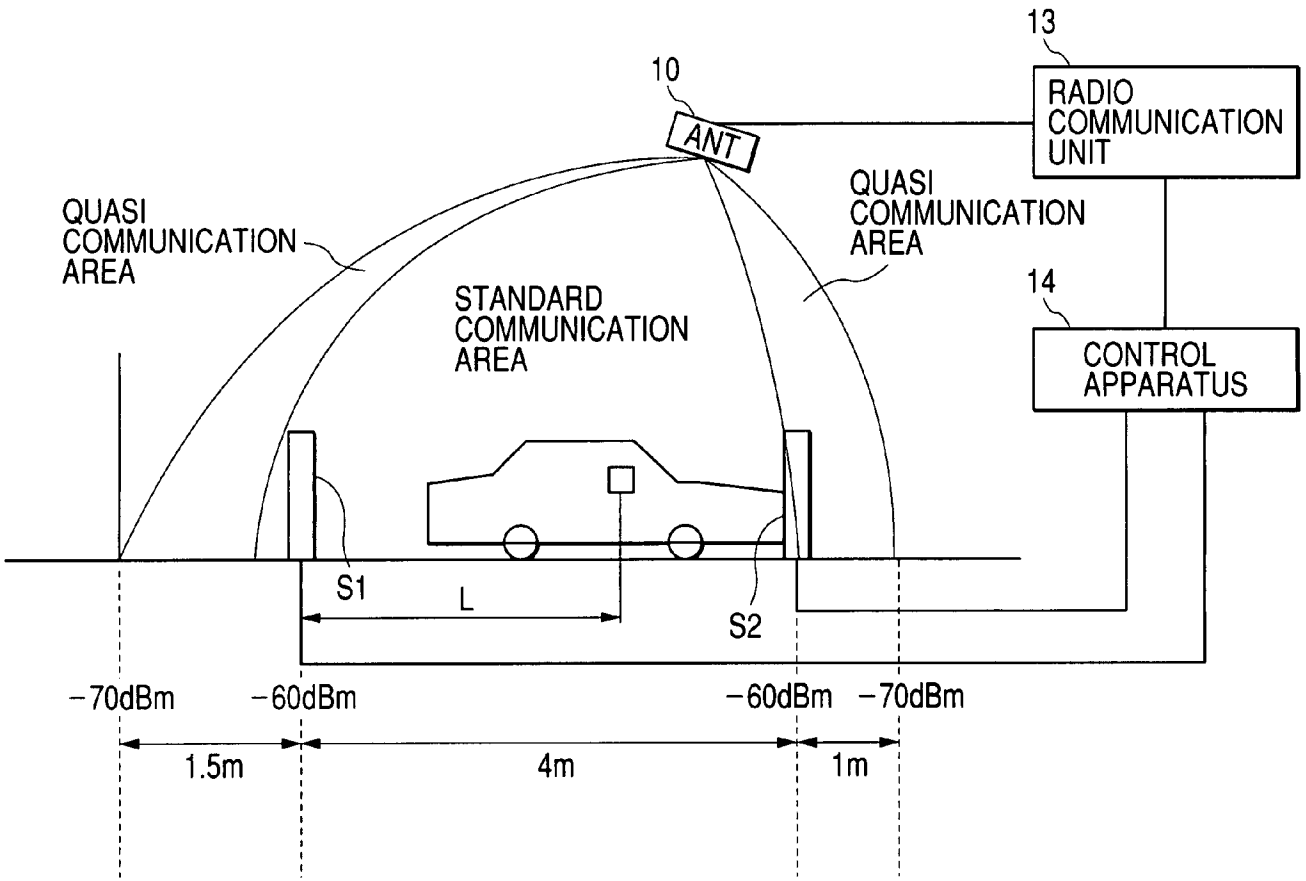
FIG. 4 PRIOR ART
FIG. 4 is a side view of the tollgate in FIG. 1 and a vehicle whose nose reaches a position of a vehicle sensor.

Radio communications between the road-side radio communication unit 13 (see FIG. 2) and an on-vehicle device of an incoming vehicle are terminated when the vehicle sensor S2 detects the front of the vehicle. In the case where the present vehicle has a long nose as shown in FIG. 4, the distance L traveled by the on-vehicle device in the standard radio-communication service area 18 is relatively short at the moment when the front of the vehicle reaches the position of the vehicle sensor S2. Accordingly, there is a chance that the road-side radio communication unit 13 and the on-vehicle device are disconnected from each other before necessary radio communications therebetween have not been completed yet.

Figure 5:
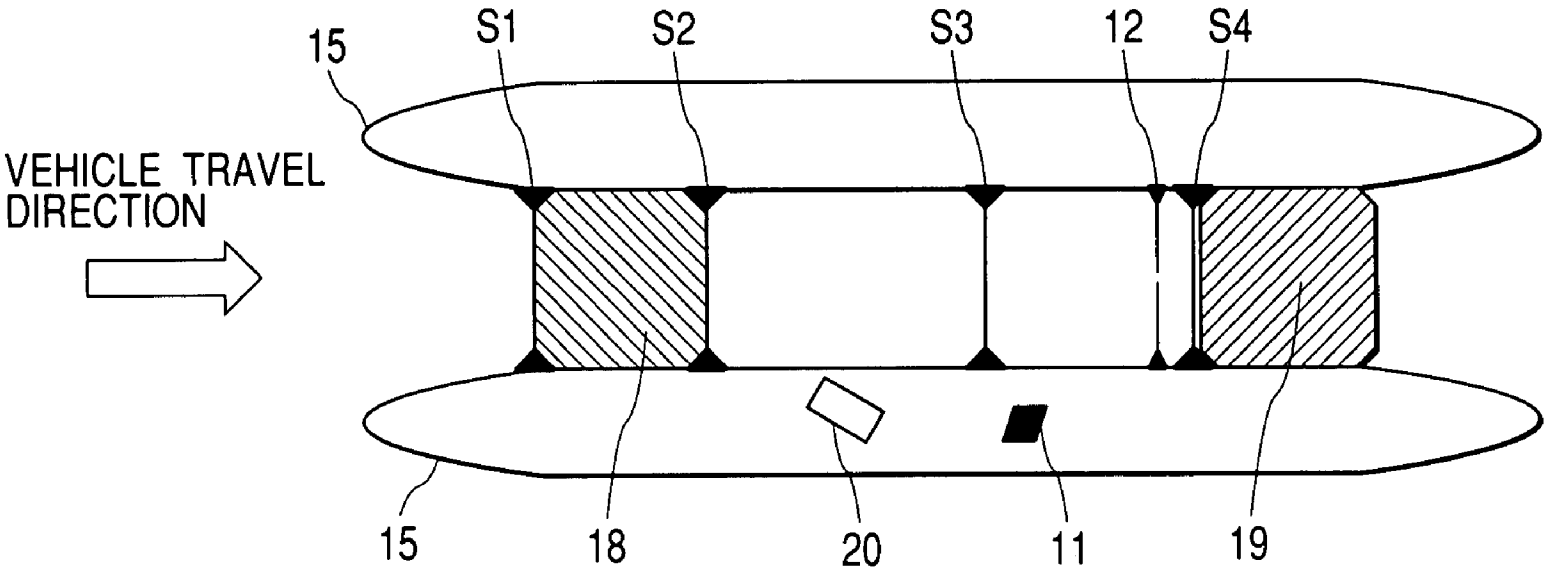
FIG. 5 PRIOR ART
FIG. 5 is a plan view of a tollgate in a second prior-art ETC system.

FIG. 5 shows a tollgate in a second prior-art ETC system. In the tollgate of FIG. 5, there are a first radio-communication service area 18 and a second radio-communication service area 19 extending over separate regions of a lane. The first and second radio-communication service areas 18 and 19 are provided by first and second separate road-side antennas, respectively. The second prior-art ETC system is similar to the first prior-art ETC system (see FIGS. 1 and 2) except for additional system elements including a vehicle-type detection device 20, a vehicle sensor S3, the second road-side antenna (not shown), and a second road-side radio communication unit (not shown). The vehicle-type detection device 20 acts to detect the type of a vehicle passing through the first radio-communication service area 18. The vehicle sensor S3 is located between vehicle sensors S2 and S4. The output signal from the vehicle sensor S3 is used in deciding a timing of opening the gate member. The second road-side antenna provides the second radio-communication service area 19. The second radio-communication service area 19 extends ahead of the vehicle sensor S4. The second road-side radio communication unit is connected to the second road-side antenna and a control apparatus 14 (see FIG. 2).

The second prior-art ETC system (see FIG. 5) decides whether an incoming vehicle in the first radio-communication service area 18 is of the ETC type or the non-ETC type as the first prior-art ETC system (see FIGS. 1 and 2) does. When the present vehicle is decided to be of the ETC type, the second prior-art ETC system automatically implements an accounting process as the first prior-art ETC system does.

In the second prior-art ETC system (see FIG. 5), the vehicle-type detection device 20 senses the number of axles of a vehicle passing through the first radio-communication service area 18. The vehicle-type detection device 20 detects the type of the present vehicle on the basis of the sensed number of the axles thereof. The vehicle-type detection device 20 outputs a signal representative of the detected vehicle type to the control apparatus 14 (see FIG. 2). In the case where the present vehicle is of the ETC type, radio communications are carried out between a first road-side radio communication unit 13 (see FIG. 2) and an on-vehicle device of the present vehicle. From the radio communications, the first road-side radio communication unit 13 gets information of the type of the present vehicle. The first road-side radio communication unit 13 outputs the information of the type of the present vehicle to the control apparatus 14. The control apparatus 14 decides whether or not the vehicle type detected by the vehicle-type detection device 20 is equal to the vehicle type notified by the first road-side radio communication unit 13. During the radio communications, the first road-side radio communication unit 13 transmits accounting information to the on-vehicle device of the present vehicle. The accounting information is written into a memory within the on-vehicle device.

When the vehicle sensor S3 detects an incoming vehicle, the vehicle sensor S3 informs the control apparatus 14 (see FIG. 2) of the vehicle detection. At this time, the control apparatus 14 commands a drive machine 12 (see FIG. 2) to open or close a gate member in response to a result of the decision as to whether the present vehicle is of the ETC type or the non-ETC type.

When the vehicle sensor S4 detects the front of the present vehicle, the vehicle sensor S4 informs the control apparatus 14 (see FIG. 2) of the vehicle-front detection. In the case where the vehicle type detected by the vehicle-type detection device 20 is different from the vehicle type notified by the first road-side radio communication unit 13, the control apparatus 14 starts the second road-side radio communication unit in response to the information of the vehicle-front detection from the vehicle sensor S4 so that radio communications are carried out between the second road-side radio communication unit and the on-vehicle device of the present vehicle. During the radio communications, the control apparatus 14 accesses the memory within the on-vehicle device of the present vehicle via the second road-side radio communication unit. The control apparatus 14 corrects the previously-mentioned accounting information in the on-vehicle device memory in response to the vehicle type detected by the vehicle-type detection device 20.

When the vehicle sensor S4 detects the tail of the present vehicle, the vehicle sensor S4 informs the control apparatus 14 (see FIG. 2) of the vehicle-tail detection. The control apparatus 14 commands the drive machine 12 in response to the information of the vehicle-tail detection to close the gate member. In addition, the control apparatus 14 deactivates the second road-side radio communication unit in response to the information of the vehicle-tail detection, thereby terminating the radio communications between the second road-side radio communication unit and the on-vehicle device of the present vehicle if they are implemented.

In the second prior-art ETC system (see FIG. 5), radio communications with an on-vehicle device in the first radio-communication service area 18 and radio communications with an on-vehicle device in the second radio-communication service area 19 can be simultaneously executed on a time sharing basis to prevent interference therebetween.

The second prior-art ETC system (see FIG. 5) has problems indicated below. Radio communications between the second road-side radio communication unit and an on-vehicle device of a vehicle are terminated when the vehicle sensor S4 detects the tail of the vehicle. There is a chance that the second road-side radio communication unit and the on-vehicle device are disconnected from each other before necessary radio communications therebetween have not been completed yet.

The simultaneous execution of first radio communications with an on-vehicle device in the first radio-communication service area 18 and second radio communications with an on-vehicle device in the second radio-communication service area 19 on a time sharing basis shortens the total time assigned to the first radio communications and the total time assigned to the second radio communication. Accordingly, there is a chance that the first road-side radio communication unit and the related on-vehicle device are disconnected from each other before necessary radio communications therebetween have not been completed yet, and that the second road-side radio communication unit and the related on-vehicle device are disconnected from each other before necessary radio communications therebetween have not been completed yet.

In the case where the tollgate of FIG. 5 is provided with a countermeasure against reflection of radio waves, the related cost is relatively high.

First Embodiment

Figure 6:
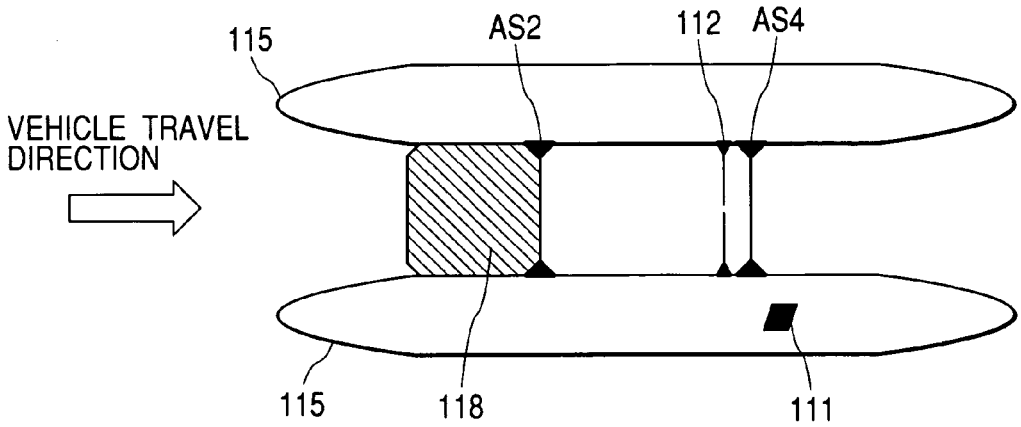
FIG. 6 is a plan view of a tollgate in an ETC system according to a first embodiment of this invention.
Figure 8:
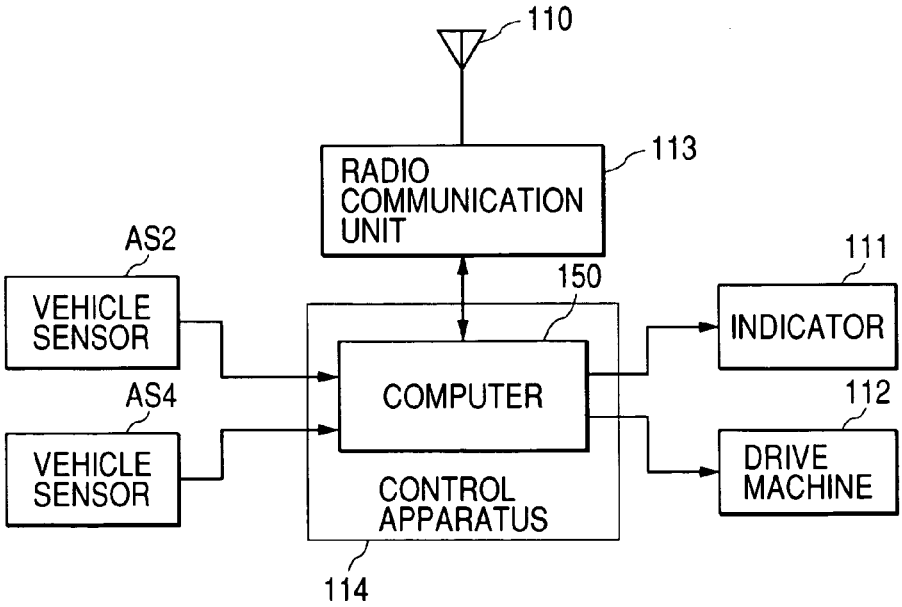
FIG. 8 is a block diagram of an electric portion of the tollgate in FIGS. 6 and 7.
Figure 7:
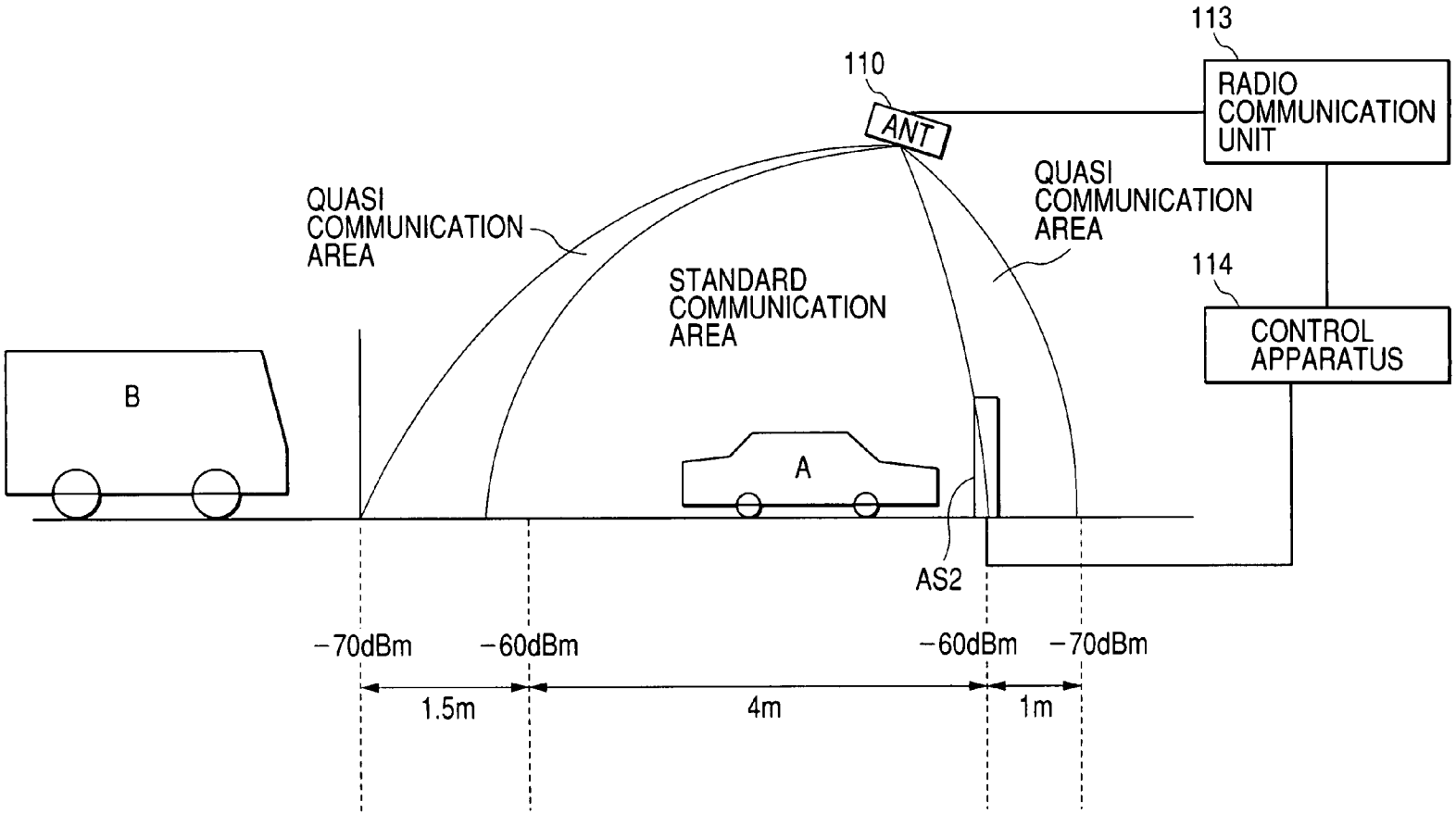
FIG. 7 is a side view of the tollgate in FIG. 6.

FIGS. 6, 7, and 8 show a tollgate in an ETC system (an electronic toll collection system) according to a first embodiment of this invention. With reference to FIGS. 6, 7, and 8, the tollgate includes a road-side antenna 110, a road-side indicator 111, a drive machine 112, a road-side radio communication unit 113, a control apparatus 114, and vehicle sensors AS2 and AS4. Here, "road-side" means "tollgate-side" opposite to "vehicle-side".

The road-side antenna 110 is located above a lane. The road-side antenna 110 is connected to the road-side radio communication unit 113. There are islands 115 extending along the opposite sides of the lane. The load-side indicator 111 is located on one of the islands 115. The drive machine 112 is connected to a gate member associated with the lane. The drive machine 112 moves the gate member between an open position and a closed position. The control apparatus 114 is connected to the road-side indicator 111, the drive machine 112, the road-side radio communication unit 113, and the vehicle sensors AS2 and AS4.

The vehicle sensor AS2 and AS4 are sequentially arranged along the lane in a vehicle forward direction. The gate member associated with the drive machine 112 extends ahead of the vehicle sensor AS2. The vehicle sensor AS4 extends ahead of the gate member connected to the drive machine 112. The road-side indicator 111 is located near the gate member and the vehicle sensor AS4.

Each of the vehicle sensors AS2 and AS4 includes a photo-transmitter and a photo-receiver which are located at the opposite sides of the lane, respectively. The photo-transmitter emits a light beam toward the photo-receiver along an optical path perpendicular to the lane. The light beam does not reach the photo-receiver when a vehicle blocks the optical path. The light beam reaches the photo-receiver in the absence of a vehicle from the optical path. The photo-receiver converts the presence and the absence of the received light beam into an electric signal representing whether or not a vehicle is in a lane position corresponding to the position of the vehicle sensor. The photo-receiver outputs the electric signal to the control apparatus 114 as an output signal of the vehicle sensor.

The road-side radio communication unit 113 includes a radio communication transceiver. The road-side radio communication unit 113 is controlled by the control apparatus 114, feeding a radio signal to the road-side antenna 110. The road-side antenna 110 radiates the radio signal toward the lane as a downward radio signal. Every ETC vehicle has an on-vehicle device including a combination of an antenna and a radio communication unit (a radio communication transceiver). The on-vehicle device can receive the downward radio signal. The on-vehicle device can transmit an upward radio signal. The upward radio signal is received by the road-side antenna 110. The received radio signal is fed from the road-side antenna 110 to the road-side radio communication unit 113. The road-side radio communication unit 113 derives information from the received radio signal. The road-side radio communication unit 113 outputs a signal representative of the derived information to the control apparatus 114. Also, the road-side radio communication unit 113 informs the control apparatus 114 of the presence of the received radio signal.

The control apparatus 114 includes a computer 150 having a combination of an input/output port, a CPU, a ROM, and a RAM. The computer 150 is connected to the vehicle sensors AS2 and AS4, the road-side indicator 111, the drive machine 112, and the road-side radio communication unit 113. The control apparatus 114 (the computer 150) operates in accordance with a program stored in the ROM. The program is designed to enable the control apparatus 114 to execute steps of operation which will be mentioned later.

The control apparatus 114 decides whether a vehicle "A" in question is of an ETC type or a non-ETC type, and whether the vehicle "A" should be permitted to pass or be inhibited from passing on the basis of the output signals from the vehicle sensors AS2 and AS4 and the road-side radio communication unit 113. In addition, the control apparatus 114 controls the road-side indicator 111 and the drive machine 112 on the basis of the output signals from the vehicle sensors AS2 and AS4 and the road-side radio communication unit 113. Specifically, when it is decided that the vehicle "A" should be permitted to pass, the road-side indicator 111 is controlled to display "go ahead" to the vehicle "A". At the same time, the drive machine 112 is controlled to open the gate member. When it is decided that the vehicle "A" should be inhibited from passing, the road-side indicator 111 is controlled to display "stop" to the vehicle "A". At the same time, the drive machine 112 is controlled to maintain the gate member at its closed position or to move the gate member to its closed position.

The position and directivity of the road-side antenna 110 are chosen to provide a standard radio-communication service area 118 extending over a region of the lane in the rear of the vehicle sensor AS2 and having a length of about 4 m along the longitudinal direction of the lane. The front edge of the standard radio-communication service area 118 is positionally equal to the vehicle sensor AS2. The strength of the electric field of radio wave radiated by the road-side antenna 110 is basically equal to or greater than −60 dBm only in the standard radio-communication service area 118. Around the standard radio-communication service area 118, there is a quasi radio-communication service area in which the strength of the electric field of radio wave radiated by the road-side antenna 110 is between −60 dBm and −70 dBm.

The road-side antenna 110 continuously, substantially continuously, or repetitively radiates a downward polling radio signal into the standard radio-communication service area 118. An incoming vehicle passes through the standard radio-communication service area 118 before being successively detected by the vehicle sensors AS2 and AS4.

In the case where an incoming vehicle of the ETC type enters the standard radio-communication service area 118, an on-vehicle device thereon transmits an upward radio signal (a response radio signal) in response to the downward polling radio signal. The response radio signal is caught by the road-side antenna 110, being fed to and received by the road-side radio communication unit 113. The road-side radio communication unit 113 informs the control apparatus 114 of the response reception. The control apparatus 114 decides that an ETC vehicle has come on the basis of the information of the reception of the response radio signal. Then, the control apparatus 114 controls the road-side radio communication unit 113 to implement regular radio communications with the on-vehicle device of the present ETC vehicle. The control apparatus 114 automatically implements an accounting process through the regular radio communications with the present ETC vehicle. In addition, the control apparatus 114 drives the road-side indicator 111 to display "go ahead". Furthermore, the control apparatus 114 commands the drive machine 112 to open the gate member.

When the vehicle sensor AS2 detects the present ETC vehicle, the vehicle sensor AS2 informs the control apparatus 114 of the ETC-vehicle detection. The control apparatus 114 controls the road-side radio communication unit 113 in response to the information of the ETC-vehicle detection, thereby terminating the regular radio communications between the road-side radio communication unit 113 and the on-vehicle device of the present ETC vehicle.

When the vehicle sensor AS4 detects the present ETC vehicle, the vehicle sensor AS4 informs the control apparatus 114 of the ETC-vehicle detection. The control apparatus 114 commands the drive machine 112 in response to the information of the ETC-vehicle detection to close the gate member.

On the other hand, in the case where an incoming vehicle of the non-ETC type enters the standard radio-communication service area 118, a response radio signal remains absent. When the vehicle sensor AS2 detects the present non-ETC vehicle, the vehicle sensor AS2 informs the control apparatus 114 of the vehicle detection. The control apparatus 114 recognizes that a response radio signal remains absent before the vehicle detection is notified by the vehicle sensor AS2. In this case, the control apparatus 114 decides that the present vehicle is of the non-ETC type. Then, the control apparatus 114 drives the road-side indicator 111 to display "stop". After the present non-ETC vehicle completes paying toll, the control apparatus 114 commands the drive machine 112 to open the gate member. When the vehicle sensor AS4 detects the present non-ETC vehicle, the vehicle sensor AS4 informs the control apparatus 114 of the vehicle detection. The control apparatus 114 commands the drive machine 112 in response to the information of the vehicle detection to close the gate member.

Figure 9:
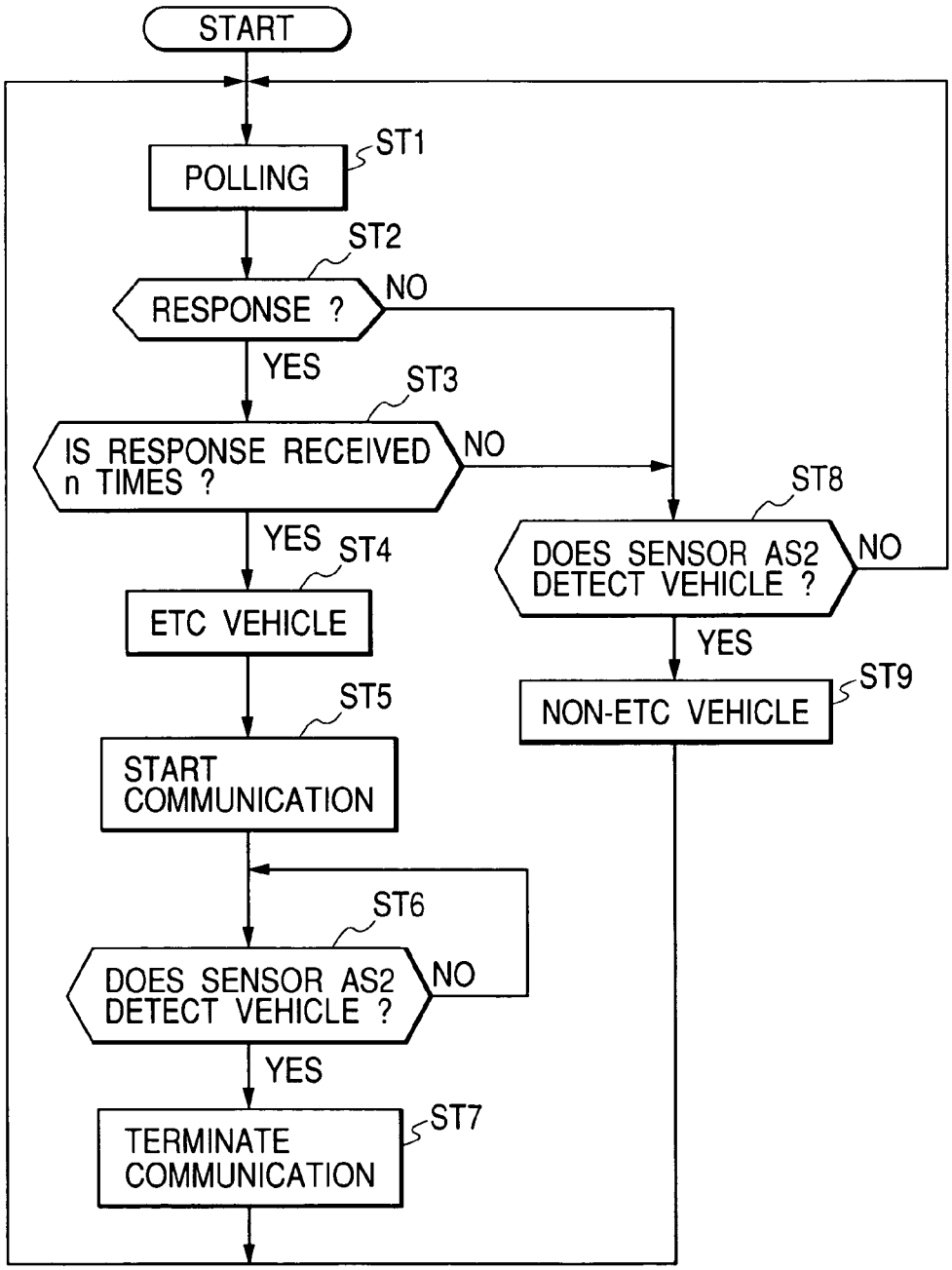
FIG. 9 is a flowchart of a segment of a program for a computer in FIG. 8.

As previously mentioned, the control apparatus 114 (the computer 150) operates in accordance with a program. FIG. 9 shows a segment of the program.

With reference to FIG. 9, a first step ST1 of the program segment controls the road-side radio communication unit 113 to transmit a polling radio signal. The polling radio signal is continuously, substantially continuously, or repetitively radiated by the road-side antenna 110 into the standard radio-communication service area 118.

A step ST2 following the step ST1 decides whether or not at least one response to the polling radio signal is received by referring to the output signal of the road-side radio communication unit 113. When at least one response to the polling radio signal is received, the program advances from the step ST2 to a step ST3. Otherwise, the program advances from the step ST2 to a step ST8.

The step ST3 decides whether or not "n" responses to the polling radio signal are received at a time interval or time intervals shorter than a predetermined reference. Here, "n" denotes a preset natural number equal to or greater than 2. Preferably, the number "n" is equal to 2 or 3. When "n" responses to the polling radio signal are received, the program advances from the step ST3 to a step ST4. Otherwise, the program advances from the step ST3 to the step ST8.

The step ST4 decides that the present vehicle is of the ETC type. The step ST4 sets a vehicle-related flag to a state corresponding to the ETC type.

A step ST5 following the step ST4 controls the road-side radio communication unit 113 to implement regular radio communications with the on-vehicle device of the present ETC vehicle. The step ST5 implements an accounting process. After the step ST5, the program advances to a step ST6.

The step ST6 decides whether or not a vehicle is detected by the vehicle sensor AS2 on the basis of the output signal therefrom. When a vehicle is not detected, the step ST6 is repeated. When a vehicle is detected, the program advances from the step ST6 to a step ST7.

The step ST7 controls the road-side radio communication unit 113 to terminate the regular radio communications with the present ETC vehicle. After the step ST7, the program returns to the step ST1.

The step ST8 decides whether or not a vehicle is detected by the vehicle sensor AS2 on the basis of the output signal therefrom. When a vehicle is not detected, the program returns from the step ST8 to the step ST1. When a vehicle is detected, the program advances from the step ST8 to a step ST9.

The step ST9 decides that the present vehicle is of the non-ETC type. The step ST9 sets the vehicle-related flag to a state corresponding to the non-ETC type. After the step ST9, the program returns to the step ST1.

Second Embodiment

Figure 10:
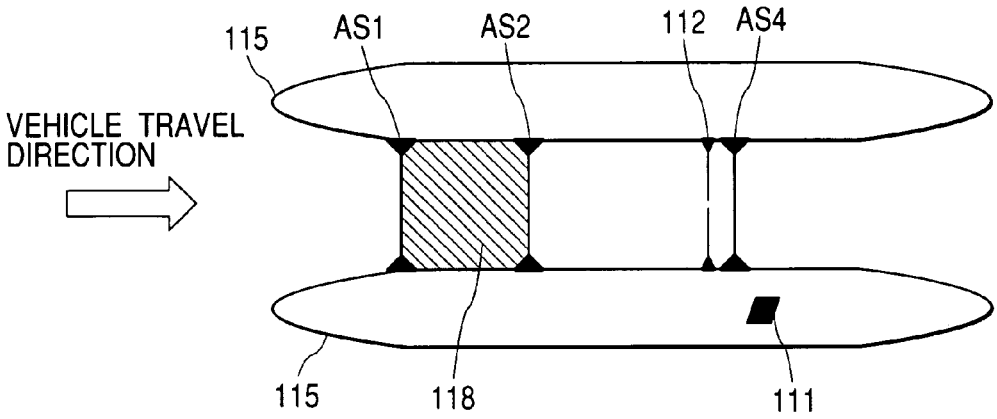
FIG. 10 is a plan view of a tollgate in an ETC system according to a second embodiment of this invention.
Figure 11:
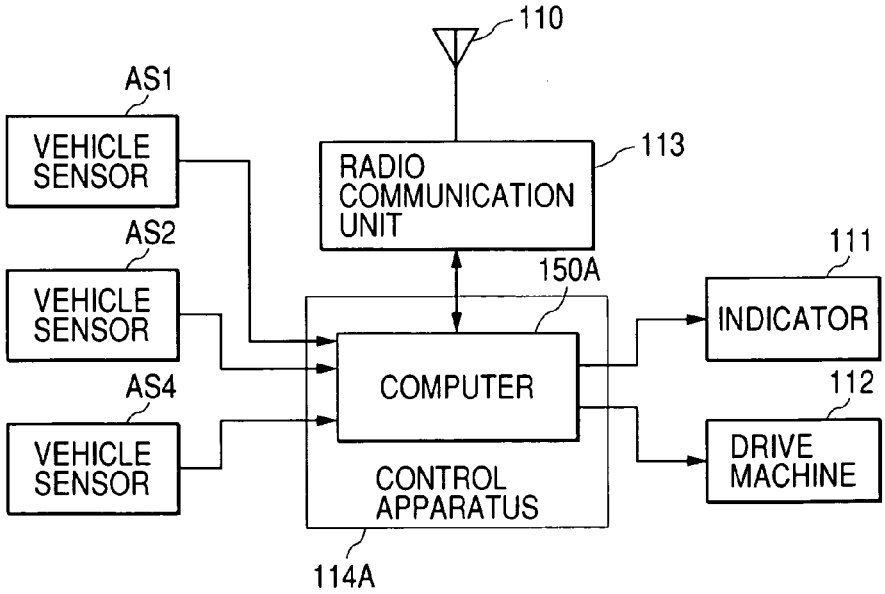
FIG. 11 is a block diagram of an electric portion of the tollgate in FIG. 10.

FIGS. 10 and 11 show a tollgate in an ETC system according to a second embodiment of this invention. The tollgate in FIGS. 10 and 11 is similar to the tollgate in FIGS. 6, 7, and 8 except for additional designs mentioned later.

The tollgate in FIGS. 10 and 11 includes a vehicle sensor AS1 which is positionally equal to the rear edge of the standard radio-communication service area 118. The tollgate in FIGS. 10 and 11 includes a control apparatus 114A and a computer 150A instead of the control apparatus 114 and the computer 150 (see FIG. 8) respectively. The vehicle sensor AS1 is connected to the computer 150A within the control apparatus 114A.

Figure 12:
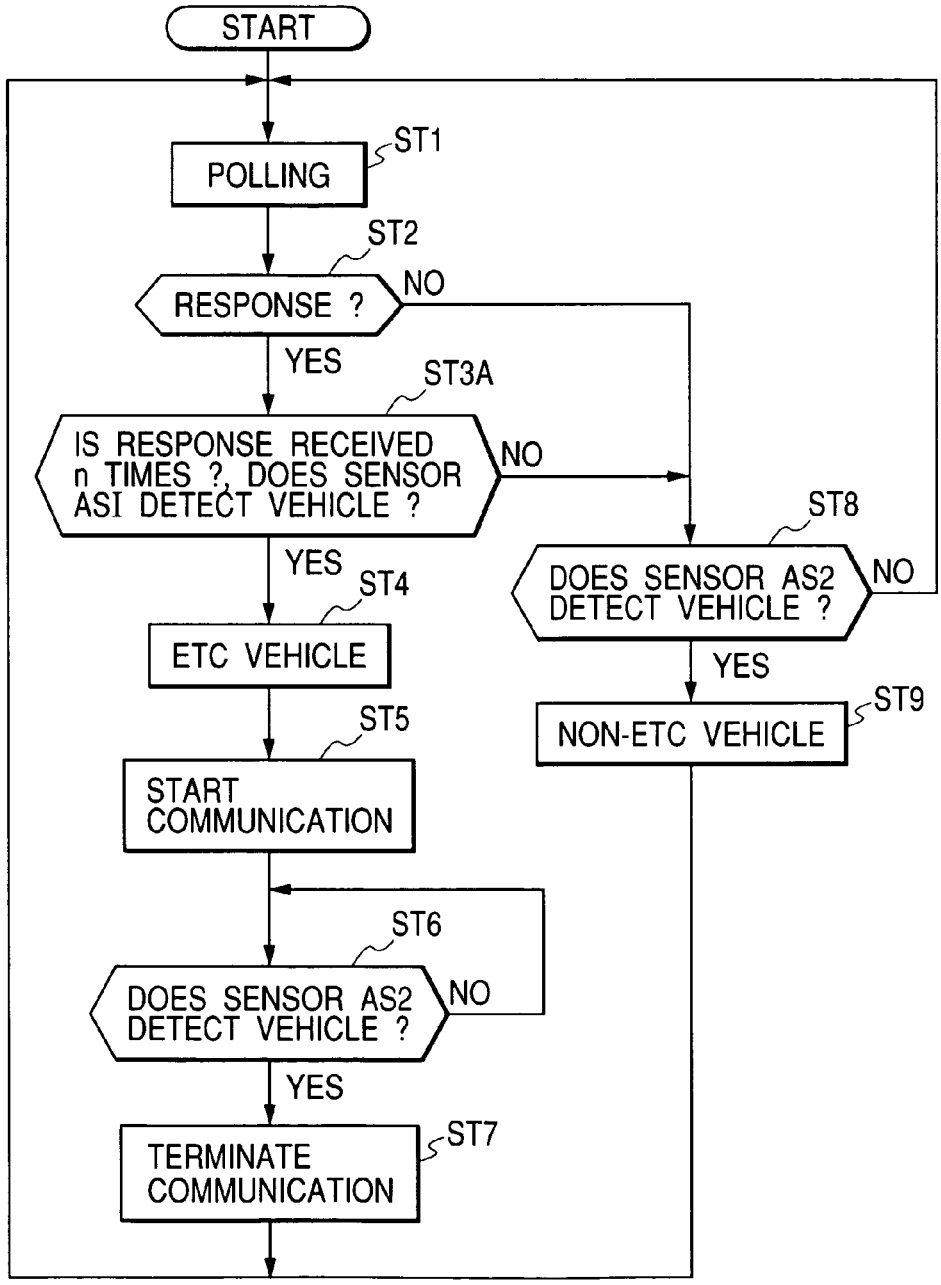
FIG. 12 is a flowchart of a segment of a program for a computer in FIG. 11.

FIG. 12 shows a segment of a program for the computer 150A (the control apparatus 114A). The program segment in FIG. 12 is similar to the program segment in FIG. 9 except that a step ST3A replaces the step ST3 (see FIG. 9).

The step ST3A decides whether or not "n" responses to the polling radio signal are received at a time interval or time intervals shorter than a predetermined reference. Here, "n" denotes a preset natural number equal to or greater than 2. Preferably, the number "n" is equal to 2 or 3. In addition, the step ST3A decides whether or not a vehicle is detected by the vehicle sensor AS1 on the basis of the output signal therefrom. In the case where "n" responses to the polling radio signal are received and a vehicle is detected by the vehicle sensor AS1, the program advances from the step ST3A to the step ST4. Otherwise, the program advances from the step ST3A to the step ST8.

Third Embodiment

Figure 13:
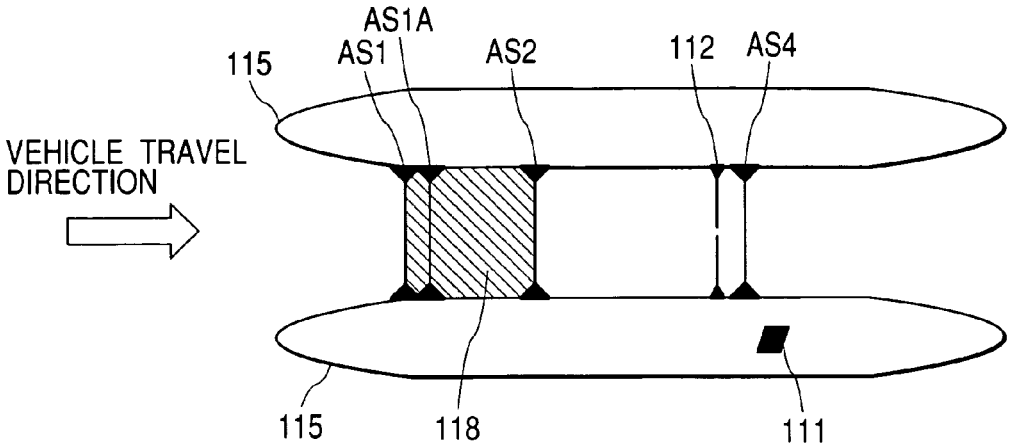
FIG. 13 is a plan view of a tollgate in an ETC system according to a third embodiment of this invention.
Figure 15:
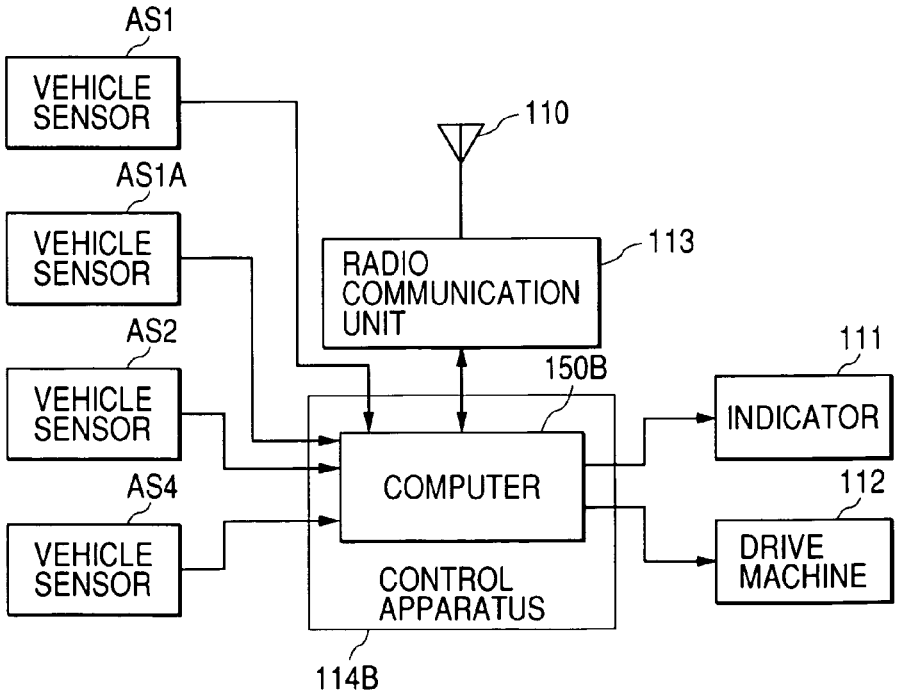
FIG. 15 is a block diagram of an electric portion of the tollgate in FIGS. 13 and 14.
Figure 14:
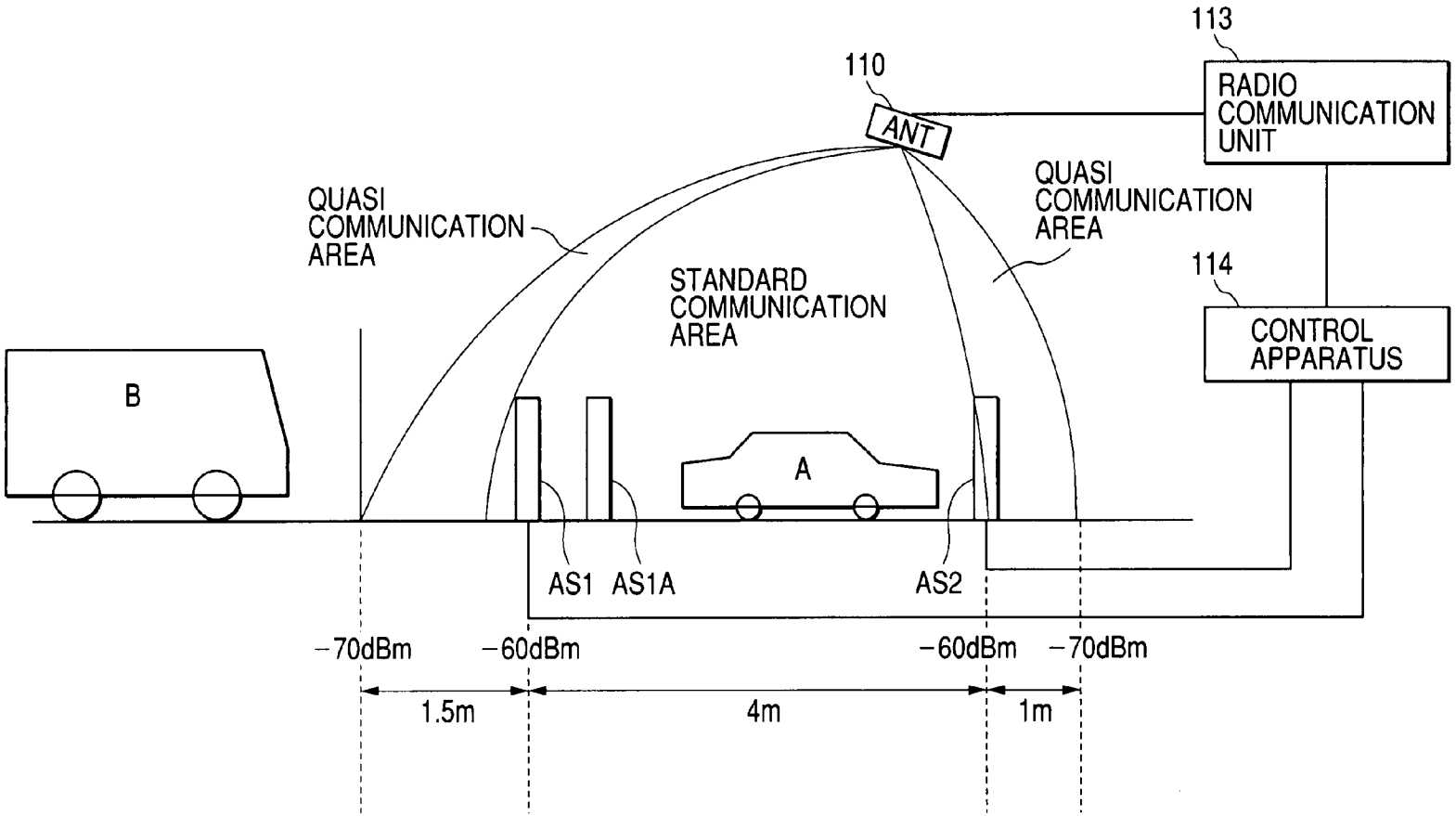
FIG. 14 is a side view of the tollgate in FIG. 13.

FIGS. 13, 14, and 15 show a tollgate in an ETC system according to a third embodiment of this invention. The tollgate in FIGS. 13, 14, and 15 is similar to the tollgate in FIGS. 6, 7, and 8 except for additional designs mentioned later.

The tollgate in FIGS. 13, 14, and 15 includes vehicle sensors AS1 and AS1A. The vehicle sensor AS1 is positionally equal to the rear edge of the standard radio-communication service area 118. The vehicle sensor AS1A extends ahead of the vehicle sensor AS1 by an interval of about 80 cm along the longitudinal direction of the lane. Thus, the position of the vehicle sensor AS1A corresponds to a position within the standard radio-communication service area 118. The tollgate in FIGS. 13, 14, and 15 includes a control apparatus 114B and a computer 150B instead of the control apparatus 114 and the computer 150 (see FIG. 8) respectively. The vehicle sensors AS1 and AS1A are connected to the computer 150B within the control apparatus 114B.

Figure 16:
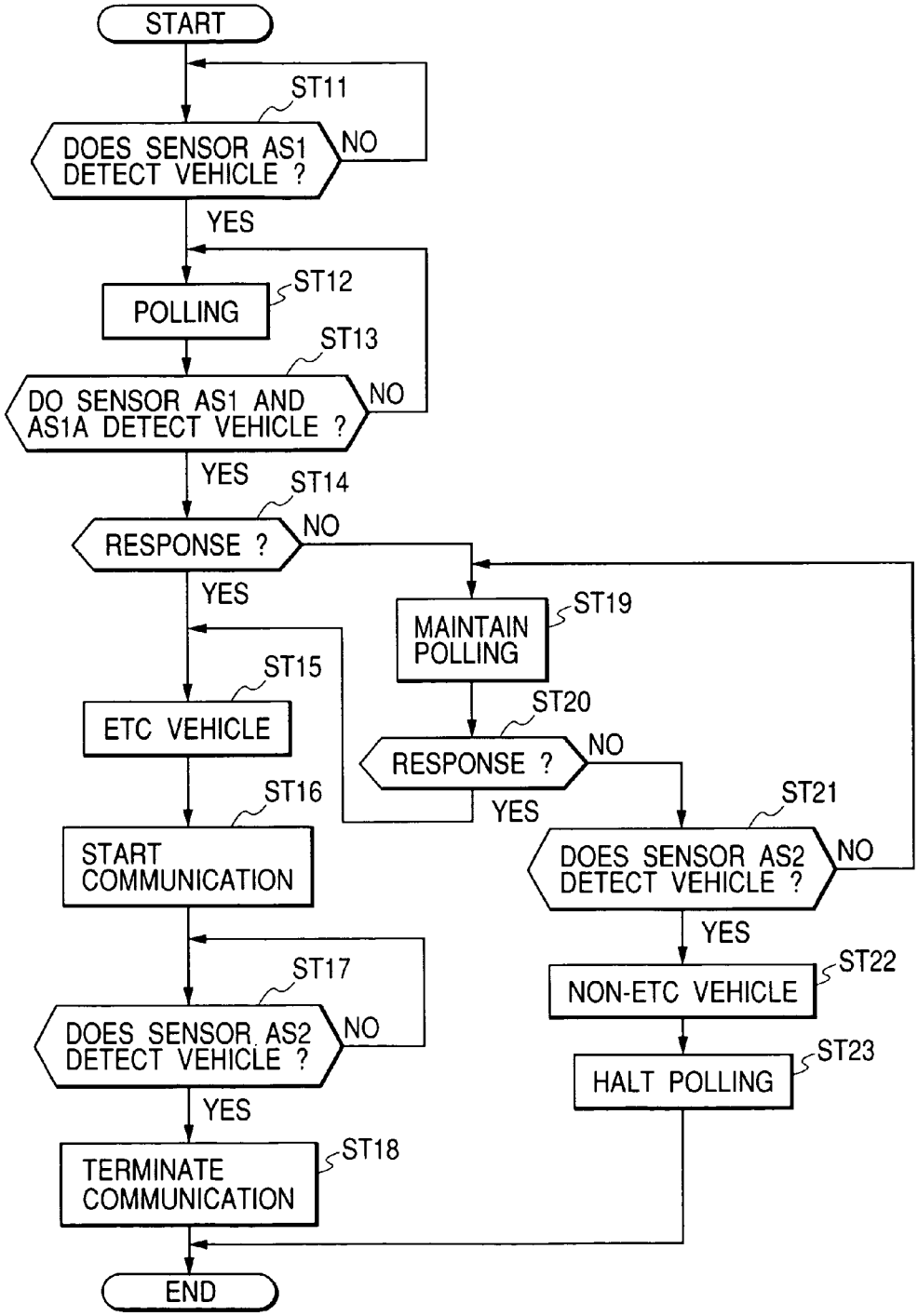
FIG. 16 is a flowchart of a segment of a program for a computer in FIG. 15.

FIG. 16 shows a segment of a program for the computer 150B (the control apparatus 114B). As shown in FIG. 16, a first step ST11 of the program segment decides whether or not a vehicle is detected by the vehicle sensor AS1 on the basis of the output signal therefrom. When a vehicle is not detected, the step ST11 is repeated. When a vehicle is detected, the program advances from the step ST11 to a step ST12.

The step ST12 controls the road-side radio communication unit 113 to transmit a polling radio signal. The polling radio signal is radiated by the road-side antenna 110 into the standard radio-communication service area 118.

A step ST13 following the step ST12 decides whether or not a vehicle is detected by both the vehicle sensors AS1 and AS1A on the basis of the output signals therefrom. When a vehicle is detected by both the vehicle sensors AS1 and AS1A, the program advances from the step ST13 to a step ST14. Otherwise, the program returns from the step ST13 to the step ST12.

The step ST14 decides whether or not a response to the polling radio signal is received by referring to the output signal of the road-side radio communication unit 113. When a response to the polling radio signal is received, the program advances from the step ST14 to a step ST15. Otherwise, the program advances from the step ST14 to a step ST19.

The step ST15 decides that the present vehicle is of the ETC type. The step ST15 sets a vehicle-related flag to a state corresponding to the ETC type.

A step ST16 following the step ST15 controls the road-side radio communication unit 113 to implement regular radio communications with the on-vehicle device of the present ETC vehicle. The step ST16 implements an accounting process. After the step ST16, the program advances to a step ST17.

The step ST17 decides whether or not a vehicle is detected by the vehicle sensor AS2 on the basis of the output signal therefrom. When a vehicle is not detected, the step ST17 is repeated. When a vehicle is detected, the program advances from the step ST17 to a step ST18.

The step ST18 controls the road-side radio communication unit 113 to terminate the regular radio communications with the present ETC vehicle. After the step ST18, the current execution cycle of the program segment ends and then the program segment restarts from the step ST11.

The step ST19 controls the road-side radio communication unit 113 to continue the transmission of the polling radio signal.

A step ST20 following the step ST19 decides whether or not a response to the polling radio signal is received by referring to the output signal of the road-side radio communication unit 113. When a response to the polling radio signal is received, the program advances from the step ST20 to the step ST15. Otherwise, the program advances from the step ST20 to a step ST21.

The step ST21 decides whether or not a vehicle is detected by the vehicle sensor AS2 on the basis of the output signal therefrom. When a vehicle is not detected, the program returns from the step ST21 to the step ST19. When a vehicle is detected, the program advances from the step ST21 to a step ST22.

The step ST22 decides that the present vehicle is of the non-ETC type. The step ST22 sets the vehicle-related flag to a state corresponding to the non-ETC type.

A step ST23 following the step ST22 controls the road-side radio communication unit 113 to terminate the transmission of the polling radio signal. After the step ST23, the current execution cycle of the program segment ends and then the program segment restarts from the step ST11.

Fourth Embodiment

Figure 17:
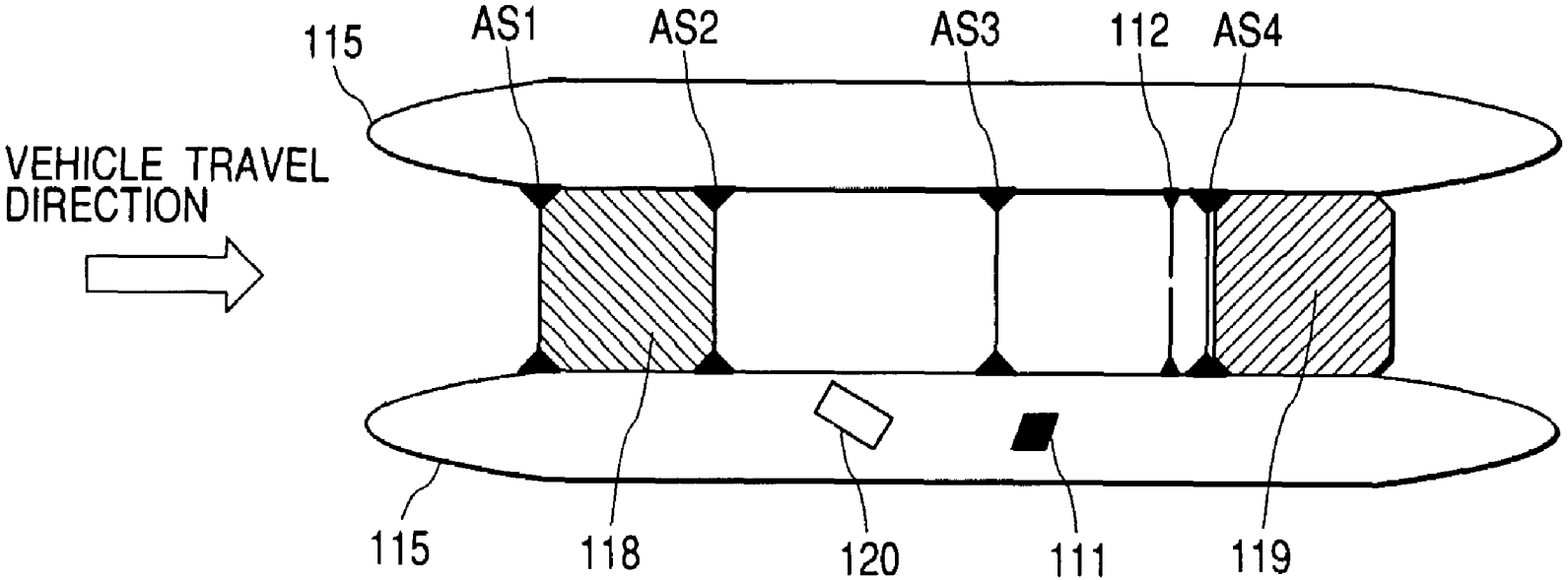
FIG. 17 is a plan view of a tollgate in an ETC system according to a fourth embodiment of this invention.
Figure 18:
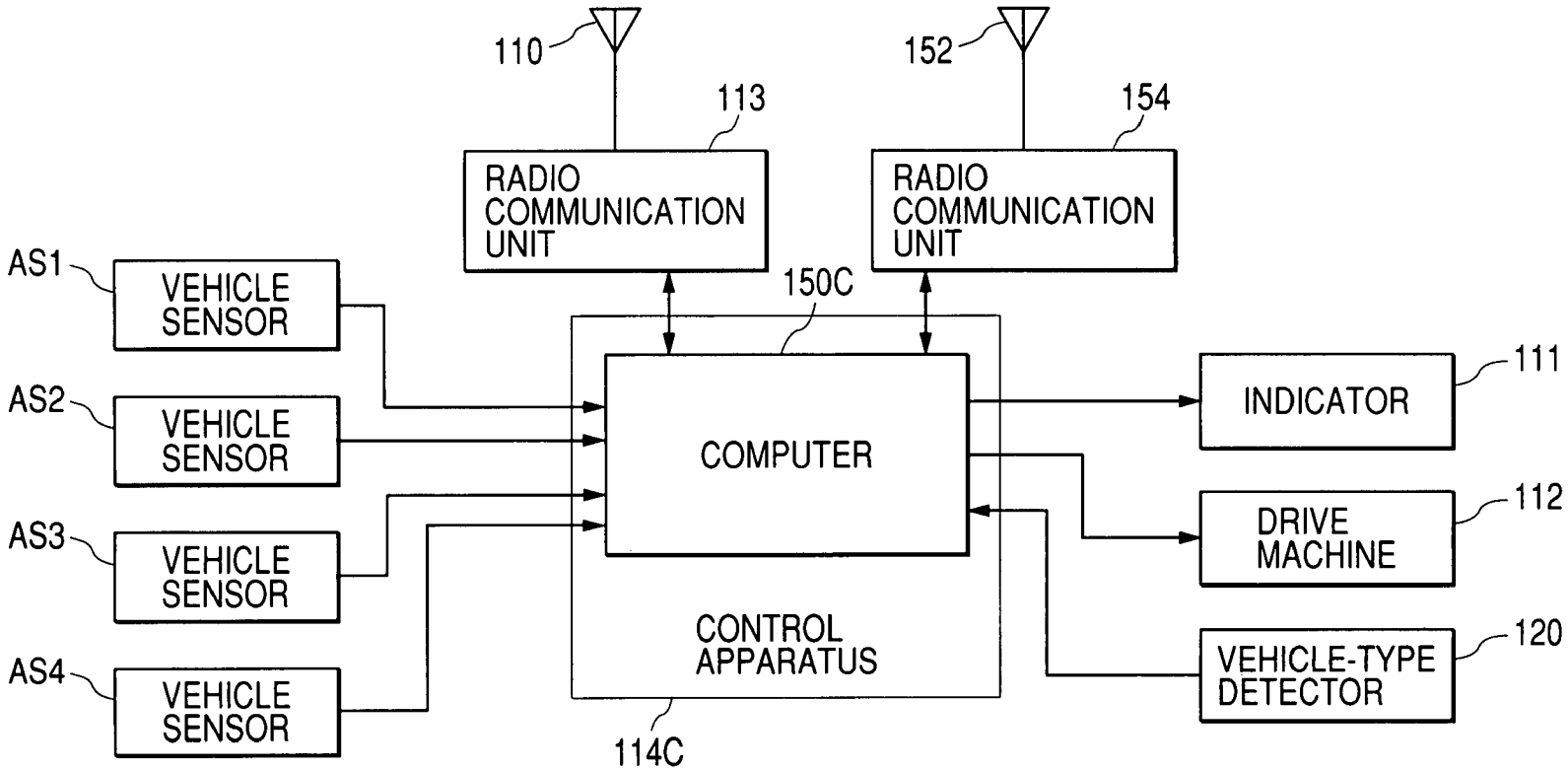
FIG. 18 is a block diagram of an electric portion of the tollgate in FIG. 17.

FIGS. 17 and 18 show a tollgate in an ETC system according to a fourth embodiment of this invention. The tollgate in FIGS. 17 and 18 is similar to the tollgate in FIGS. 6, 7, and 8 except for additional designs mentioned later.

The tollgate in FIGS. 17 and 18 includes vehicle sensors AS1 and AS3. The vehicle sensor AS1 is positionally equal to the rear edge of the standard radio-communication service area 118. The vehicle sensor AS3 is located between the vehicle sensors AS2 and AS4. The output signal from the vehicle sensor AS3 is used in deciding a timing of opening the gate member.

The tollgate of FIGS. 17 and 18 has a second radio-communication service area 119 in addition to the standard radio-communication service area 118. The second radio-communication service area 119 extends over a region of the lane ahead of the vehicle sensor AS4. The second radio-communication service area 119 is provided by a second road-side antenna 152 located above the lane. The second road-side antenna 152 is connected to a second road-side radio communication unit 154. The second road-side radio communication unit 154 includes a radio communication transceiver. The second road-side radio communication unit 154 can feed a radio signal to the second road-side antenna 152. The second road-side antenna 152 radiates the fed radio signal into the second radio-communication service area 119. The second road-side antenna 152 can catch a radio signal. The second road-side antenna 152 feeds the caught radio signal to the second road-side radio communication unit 154.

The tollgate of FIGS. 17 and 18 includes a vehicle-type detection device 120. The vehicle-type detection device 120 acts to detect the type of a vehicle passing through the standard radio-communication service area 118.

The tollgate in FIGS. 17 and 18 includes a control apparatus 114C and a computer 150C instead of the control apparatus 114 and the computer 150 (see FIG. 8) respectively. The vehicle sensors AS1 and AS3, the second road-side radio communication unit 154, and the vehicle-type detection device 120 are connected to the computer 150C within the control apparatus 114B. The control apparatus 114C (the computer 150C) operates in accordance with a program stored in an internal ROM. The program is designed to enable the control apparatus 114C to execute steps of operation which will be mentioned later.

The control apparatus 114C decides whether an incoming vehicle in the standard radio-communication service area 118 is of the ETC type or the non-ETC type. When the present vehicle is decided to be of the ETC type, the control apparatus 114C automatically implements an accounting process.

The vehicle-type detection device 120 senses the number of axles of a vehicle passing through the standard radio-communication service area 118. The vehicle-type detection device 120 detects the type of the present vehicle on the basis of the sensed number of the axles thereof. The vehicle-type detection device 120 outputs a signal representative of the detected vehicle type to the control apparatus 114C. In the case where the present vehicle is of the ETC type, radio communications are carried out between the road-side radio communication unit 113 and the on-vehicle device of the present vehicle. From the radio communications, the road-side radio communication unit 113 gets information of the type of the present vehicle. The road-side radio communication unit 113 outputs the information of the type of the present vehicle to the control apparatus 114C. The control apparatus 114 decides whether or not the vehicle type detected by the vehicle-type detection device 120 is equal to the vehicle type notified by the road-side radio communication unit 113. During the radio communications, the road-side radio communication unit 113 transmits accounting information to the on-vehicle device of the present vehicle. The accounting information is written into a memory within the on-vehicle device.

When the vehicle sensor AS3 detects an incoming vehicle, the vehicle sensor AS3 informs the control apparatus 114C of the vehicle detection. At this time, the control apparatus 114C commands the drive machine 112 to open or close the gate member in response to a result of the decision as to whether the present vehicle is of the ETC type or the non-ETC type.

When the vehicle sensor AS4 detects the front of the present vehicle, the vehicle sensor AS4 informs the control apparatus 114C of the vehicle-front detection. In the case where the vehicle type detected by the vehicle-type detection device 120 is different from the vehicle type notified by the road-side radio communication unit 113, the control apparatus 114C starts the second road-side radio communication unit 154 in response to the information of the vehicle-front detection from the vehicle sensor AS4 so that radio communications are carried out between the second road-side radio communication unit 154 and the on-vehicle device of the present vehicle. During the radio communications, the control apparatus 114C accesses the memory within the on-vehicle device of the present vehicle via the second road-side radio communication unit 154. The control apparatus 114C corrects the previously-mentioned accounting information in the on-vehicle device memory in response to the vehicle type detected by the vehicle-type detection device 120.

When the vehicle sensor AS4 detects the tail of the present vehicle, the vehicle sensor AS4 informs the control apparatus 114C of the vehicle-tail detection. The control apparatus 114C commands the drive machine 112 in response to the information of the vehicle-tail detection to close the gate member. In addition, the control apparatus 114C deactivates the second road-side radio communication unit 154 in response to the information of the vehicle-tail detection, thereby terminating the radio communications between the second road-side radio communication unit 154 and the on-vehicle device of the present vehicle if they are implemented.

Figure 19:
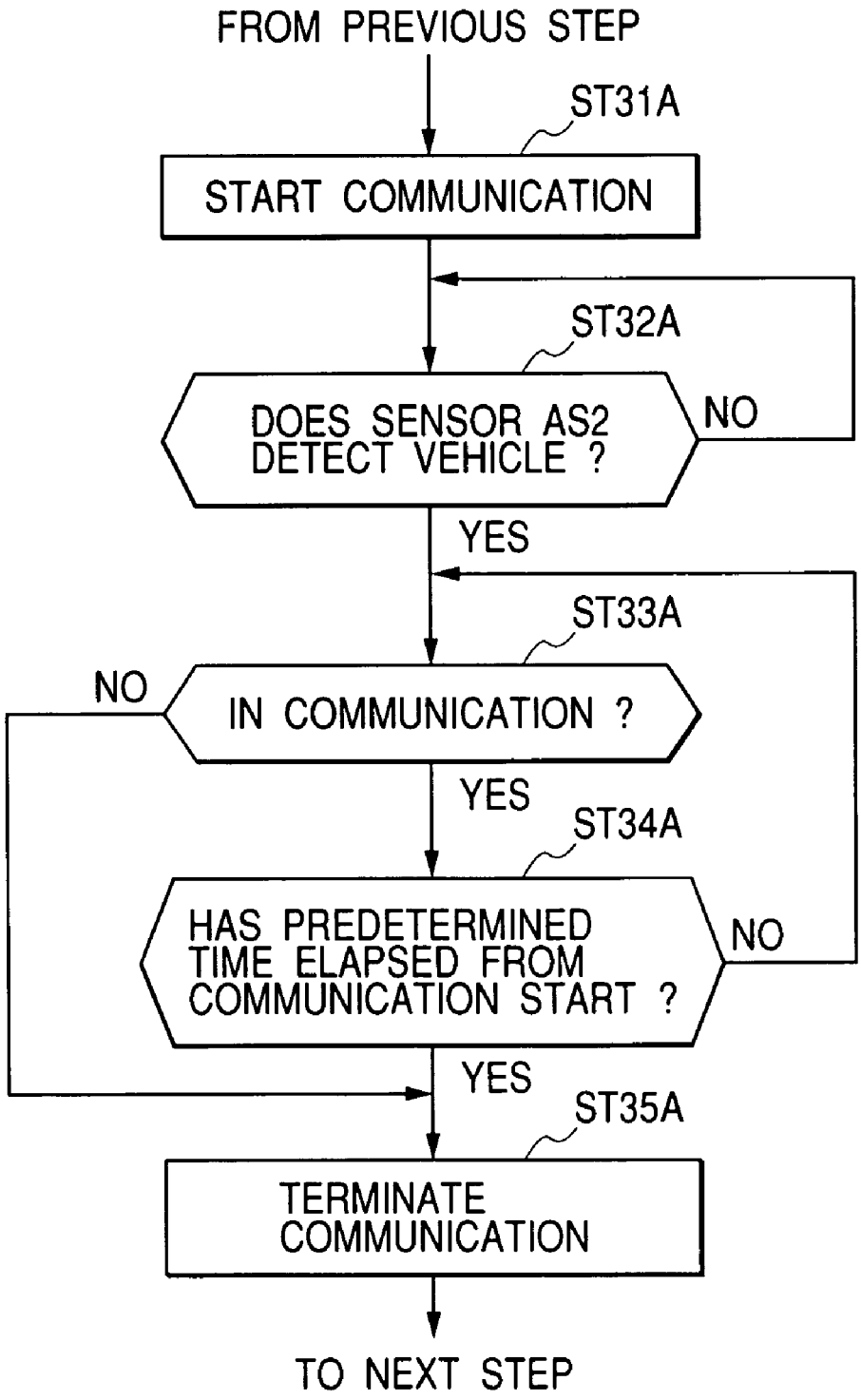
FIG. 19 is a flowchart of a first segment of a program for a computer in FIG. 18.

As previously mentioned, the control apparatus 114C (the computer 150C) operates in accordance with a program. FIG. 19 shows a first segment of the program. As shown in FIG. 19, a first step ST31A of the program segment controls the road-side radio communication unit 113 to start regular radio communications with the on-vehicle device of the present vehicle in the standard radio-communication service area 118. In addition, the step ST31A starts a timer for indicating the lapse of time from the start of the regular radio communications. After the step ST31A, the program advances to a step ST32A.

The step ST32A decides whether or not the front of a vehicle is detected by the vehicle sensor AS2 on the basis of the output signal therefrom. When the front of a vehicle is not detected, the step ST32A is repeated. When the front of a vehicle is detected, the program advances from the step ST32A to a step ST33A.

The step ST33A accesses the road-side radio communication unit 113, and decides whether or not the regular radio communications with the on-vehicle device of the present vehicle are going on now (that is, whether or not the regular radio communications with the on-vehicle device of the present vehicle have been completed). When the regular radio communications are going on now, that is, when the regular radio communications have not been completed yet, the program advances from the step ST33A to a step ST34A. Otherwise, the program jumps from the step ST33A to a step ST35A.

The step ST34A accesses the timer, and decides whether or not the lapse of time from the start of the regular radio communications reaches a predetermined time interval. When the lapse of time reaches the predetermined time interval, the program advances from the step ST34A to the step ST35A. Otherwise, the program returns from the step ST34A to the step ST33A. The predetermined time interval is equal to, for example, 100 ms.

The step ST35A controls the road-side radio communication unit 113 to terminate the regular radio communications with the on-vehicle device of the present vehicle in the standard radio-communication service area 118.

Figure 20:
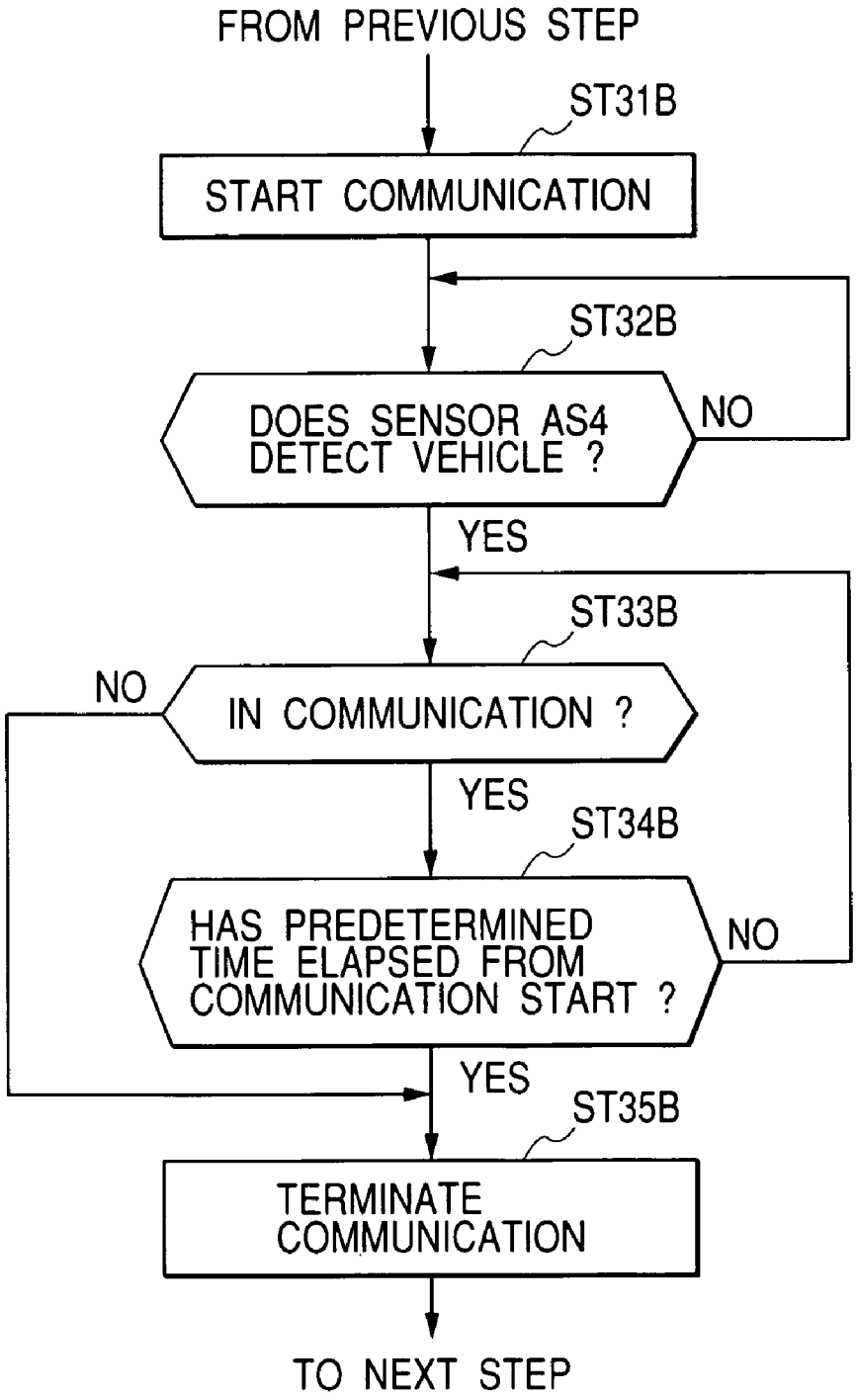
FIG. 20 is a flowchart of a second segment of the program for the computer in FIG. 18.

FIG. 20 shows a second segment of the program. As shown in FIG. 20, a first step ST31B of the program segment controls the second road-side radio communication unit 154 to start radio communications with the on-vehicle device of the present vehicle in the second radio-communication service area 119. In addition, the step ST31B starts a timer for indicating the lapse of time from the start of the radio communications. After the step ST31B, the program advances to a step ST32B.

The step ST32B decides whether or not the tail of a vehicle is detected by the vehicle sensor AS4 on the basis of the output signal therefrom. When the tail of a vehicle is not detected, the step ST32B is repeated. When the tail of a vehicle is detected, the program advances from the step ST32B to a step ST33B.

The step ST33B accesses the second road-side radio communication unit 154, and decides whether or not the radio communications with the on-vehicle device of the present vehicle are going on now (that is, whether or not the radio communications with the on-vehicle device of the present vehicle have been completed). When the radio communications are going on now, that is, when the radio communications have not been completed yet, the program advances from the step ST33B to a step ST34B. Otherwise, the program jumps from the step ST33B to a step ST35B.

The step ST34B accesses the timer, and decides whether or not the lapse of time from the start of the radio communications reaches a predetermined time interval. When the lapse of time reaches the predetermined time interval, the program advances from the step ST34B to the step ST35B. Otherwise, the program returns from the step ST34B to the step ST33B. The predetermined time interval is equal to, for example, 100 ms.

The step ST35B controls the second road-side radio communication unit 154 to terminate the radio communications with the on-vehicle device of the present vehicle in the second radio-communication service area 119.

Figure 21:
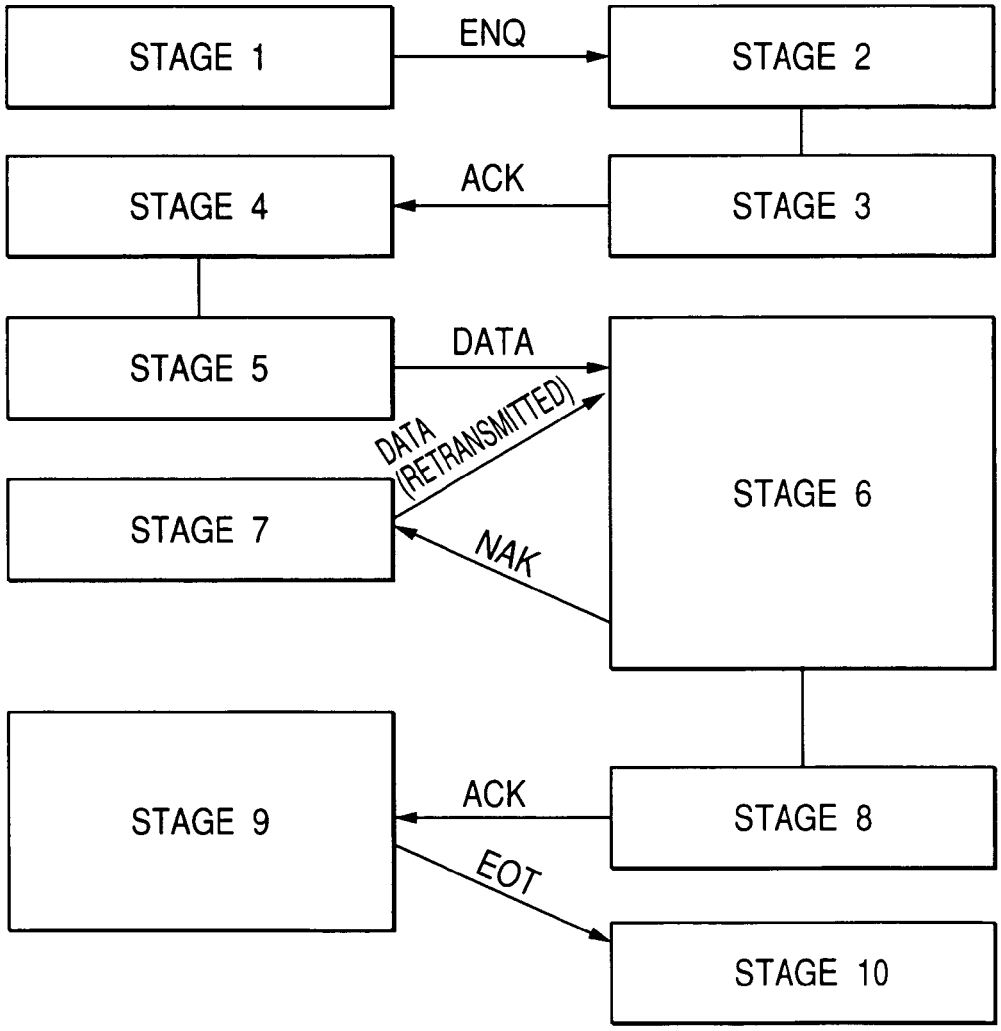
FIG. 21 is a diagram of a first example of a sequence of radio communications between an on-vehicle device and a road-side device in the ETC system of the fourth embodiment of this invention.
Figure 22:
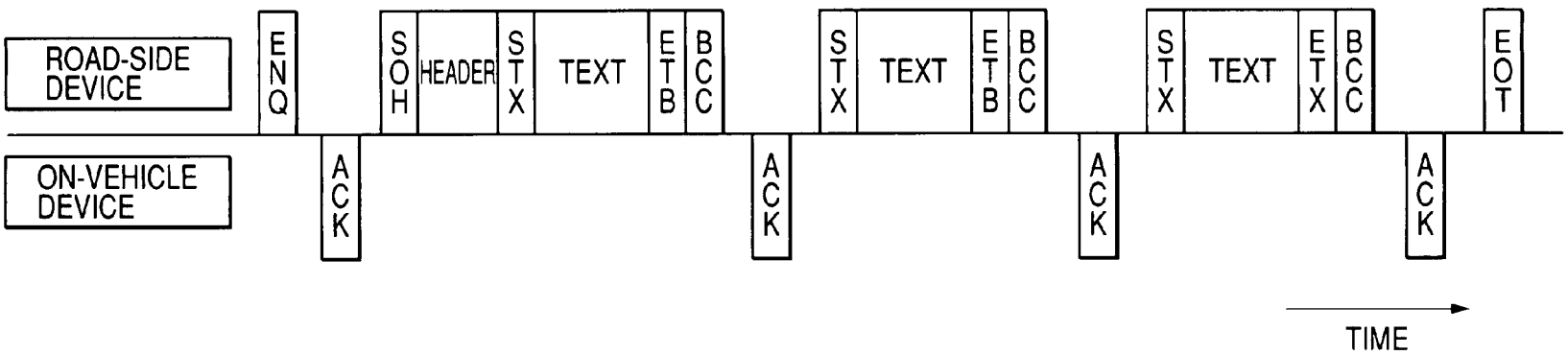
FIG. 22 is a time-domain diagram of signals transmitted during the radio communications in FIG. 21.

FIGS. 21 and 22 show a first example of the sequence of radio communications between an on-vehicle device and the road-side device (the tollgate-side device, that is, the road-side radio communication unit 113 or the second road-side radio communication unit 154).

With reference to FIGS. 21 and 22, at a stage "1" of the radio communications, the road-side device sends an ENQ signal representing the presence of data to be transmitted to the communication opposite party (the on-vehicle device).

At a stage "2" of the radio communications, the on-vehicle device receives the ENQ signal. At a stage "3" following the stage "2", the on-vehicle device recognizes the road-side device in response to the received ENQ signal. The on-vehicle device transmits an ACK signal as a positive response signal which represents an acknowledgment message, and which requires the communication opposite party to send a data block.

At a stage "4" of the radio communications, the road-side device receives the ACK signal. At a stage "5" following the stage "4", the road-side device transmits a signal of a data block. The data block contains a BCC (block check character) signal being a parity signal for enabling a receiver side to decide whether a data error (data errors) is present or absent.

At a stage "6" of the radio communications, the on-vehicle device receives the signal of the data block. The on-vehicle device decides whether or not the data block has an error in response to the BCC signal contained therein. When the data block is free from an error, the stage "6" is followed by a stage "8". When the data block has an error, the on-vehicle device transmits a NAK signal as a negative response signal which requires the communication opposite party to retransmit the signal of the data block.

At a stage "7" of the radio communications, the road-side device receives the NAK signal. The road-side device retransmits the signal of the data block in response to the received NAK signal.

At the stage "8", the on-vehicle device transmits an ACK signal as a positive response signal which represents an acknowledgment message, and which requires the communication opposite party to send a next data block.

At a stage "9" of the radio communications, the road-side device receives the ACK signal. The road-side device transmits a signal of a next data block. In the absence of a next data block, the road-side device transmits an EOT signal representing "end-of-transmission".

At a stage "10", the on-vehicle device receives the EOT signal. Then, the radio communications end.

Figure 23:
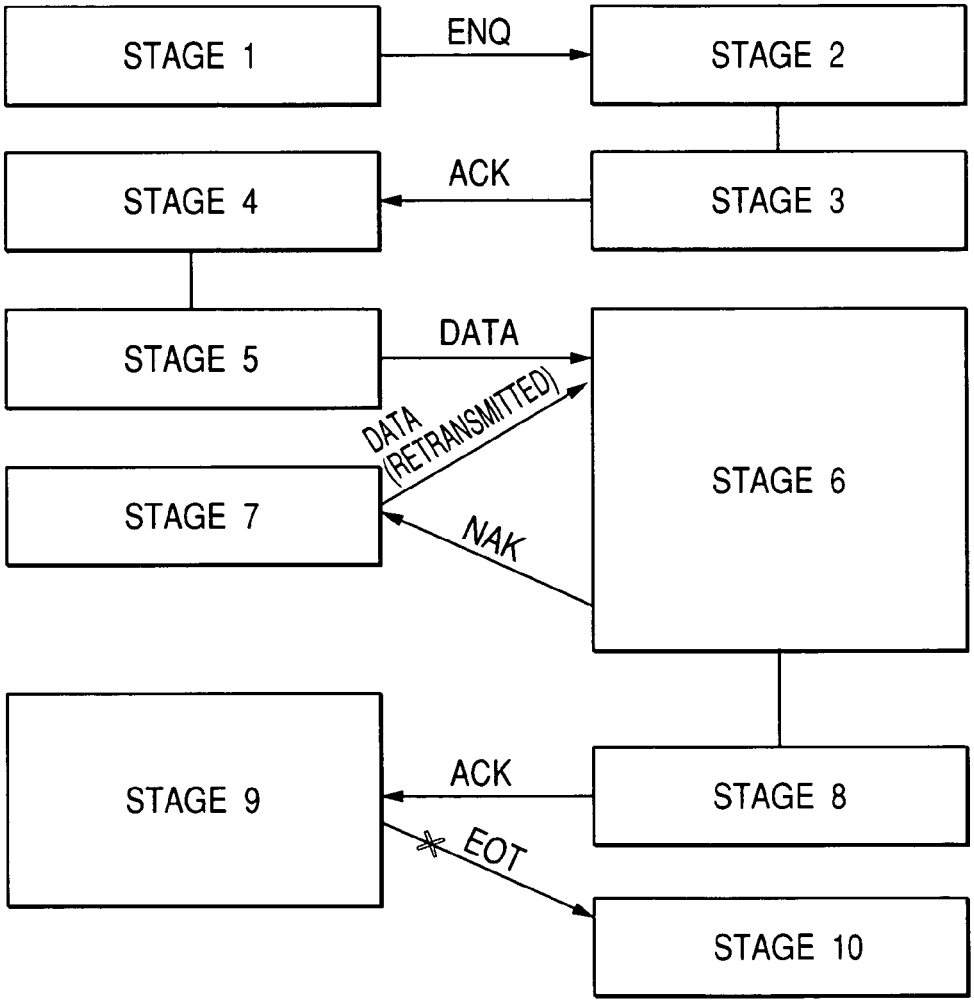
FIG. 23 is a diagram of a second example of the sequence of radio communications.

FIG. 23 shows a second example of the sequence of radio communications which is similar to that in FIGS. 21 and 22 except for the following point. With reference to FIG. 23, at the stage "9", a trouble occurs so that the road-side device fails to transmit an EOT signal. Thus, in this case, at the stage "10", the on-vehicle device does not receive any EOT signal. Even in the event that any EOT signal is not received, the on-vehicle device handles the data blocks, which have been received at the stage "6" and the similar stage or stages, as effective data blocks. In other words, the on-vehicle device handles the previously-received data blocks as effective data blocks regardless of whether or not an EOT signal is successfully received. Thus, it is possible to prevent the occurrence of a disagreement in phase of signal processing between the road-side device and the on-vehicle device.

Fifth Embodiment

Figure 24:
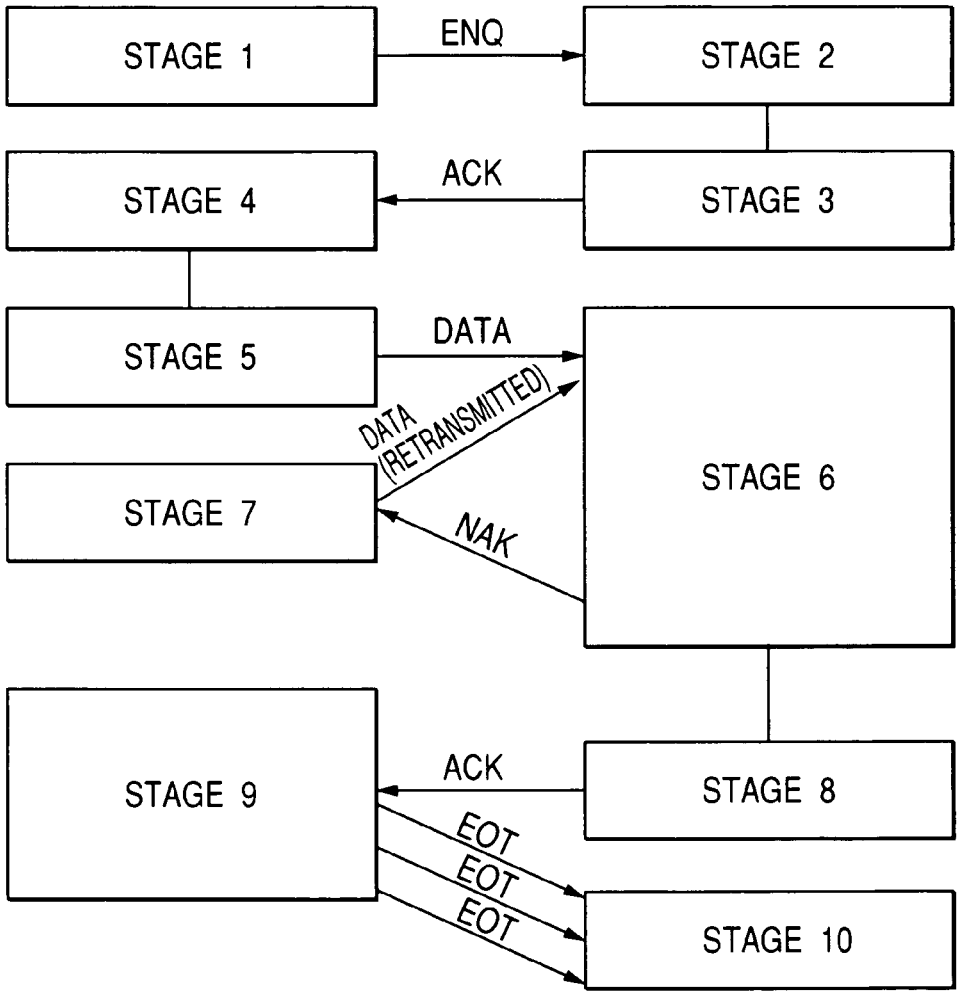
FIG. 24 is a diagram of an example of a sequence of radio communications between an on-vehicle device and a road-side device in an ETC system according to a fifth embodiment of this invention.

A fifth embodiment of this invention is similar to the fourth embodiment thereof except for a design change mentioned later. FIG. 24 shows an example of the sequence of radio communications between the on-vehicle device and the road-side device in the fifth embodiment of this invention.

With reference to FIG. 24, at a stage "9" of the radio communications, the road-side device receives the ACK signal. The road-side device transmits a signal of a next data block. In the absence of a next data block, the road-side device transmits an EOT signal representing "end-of-transmission". Specifically, the road-side device repetitively transmits the EOT signal. In other words, the road-side device transmits the EOT signal twice or more.

Sixth Embodiment

A sixth embodiment of this invention is similar to the fourth or fifth embodiment thereof except for design changes mentioned later. In the sixth embodiment of this invention, the on-vehicle device transmits an EOT signal to the road-side device once or more during radio communications therebetween. Even in the event that any EOT signal is not received, the road-side device handles data blocks, which have been received at a previous stage or stages, as effective data blocks. In other words, the road-side device handles the previously-received data blocks as effective data blocks regardless of whether or not an EOT signal is successfully received.

Seventh Embodiment

A seventh embodiment of this invention is similar to one of the fourth, fifth, and sixth embodiments thereof except for design changes mentioned later. In the seventh embodiment of this invention, a program for the computer 150C (see FIG. 18) is designed so that the mode of operation of the control apparatus 114C (see FIG. 18) can be selected from first and second types.

During the operation of the control apparatus 114C in the mode of the first type, radio communications with an on-vehicle device in the standard radio-communication service area 118 (see FIG. 17) and radio communications with an on-vehicle device in the second radio-communication service area 119 (see FIG. 17) can be simultaneously executed on a time sharing basis to prevent interference therebetween.

During the operation of the control apparatus 114C in the mode of the second type, radio communications with an on-vehicle device in the standard radio-communication service area 118 and radio communications with an on-vehicle device in the second radio-communication service area 119 are executed in a way different from the time sharing method. During the operation of the control apparatus 114C in the mode of the second type, radio communications with an on-vehicle device in the standard radio-communication service area 118 and radio communications with an on-vehicle device in the second radio-communication service area 119 may be executed on a frequency division basis. In the frequency division method, the radio-signal frequency used by the radio communications with the on-vehicle device in the standard radio-communication service area 118 differs from that used by the radio communications with the on-vehicle device in the second radio-communication service area 119.

In the seventh embodiment of this invention, during the radio communications with the on-vehicle device in the standard radio-communication service area 118, the control apparatus 114C writes information related to the first road-side antenna 110 (see FIG. 18) into a memory within the on-vehicle device. During a former stage of the radio communications with the on-vehicle device via the second road-side radio communication unit 154, the control apparatus 114C accesses the memory within the on-vehicle device and decides whether or not the information related to the first road-side antenna 110 is contained in the latest written information in the accessed memory. When the information related to the first road-side antenna 110 is contained in the latest written information in the memory within the on-vehicle device, the control apparatus 114C determines that the vehicle in question is of the ETC type traveling along the present lane and differs from an ETC vehicle in a lane adjacent to the present lane. Only in this case, the control apparatus 114C executes a later stage of the radio communications with the on-vehicle device via the second road-side radio communication unit 154. When the information related to the first road-side antenna 110 is absent from the latest written information in the memory within the on-vehicle device, the control apparatus 114C determines that the vehicle in question is an ETC vehicle traveling along a lane adjacent to the present lane. In this case, the control apparatus 114C halts or terminates the radio communications with the on-vehicle device via the second road-side radio communication unit 154.

Figure 25:
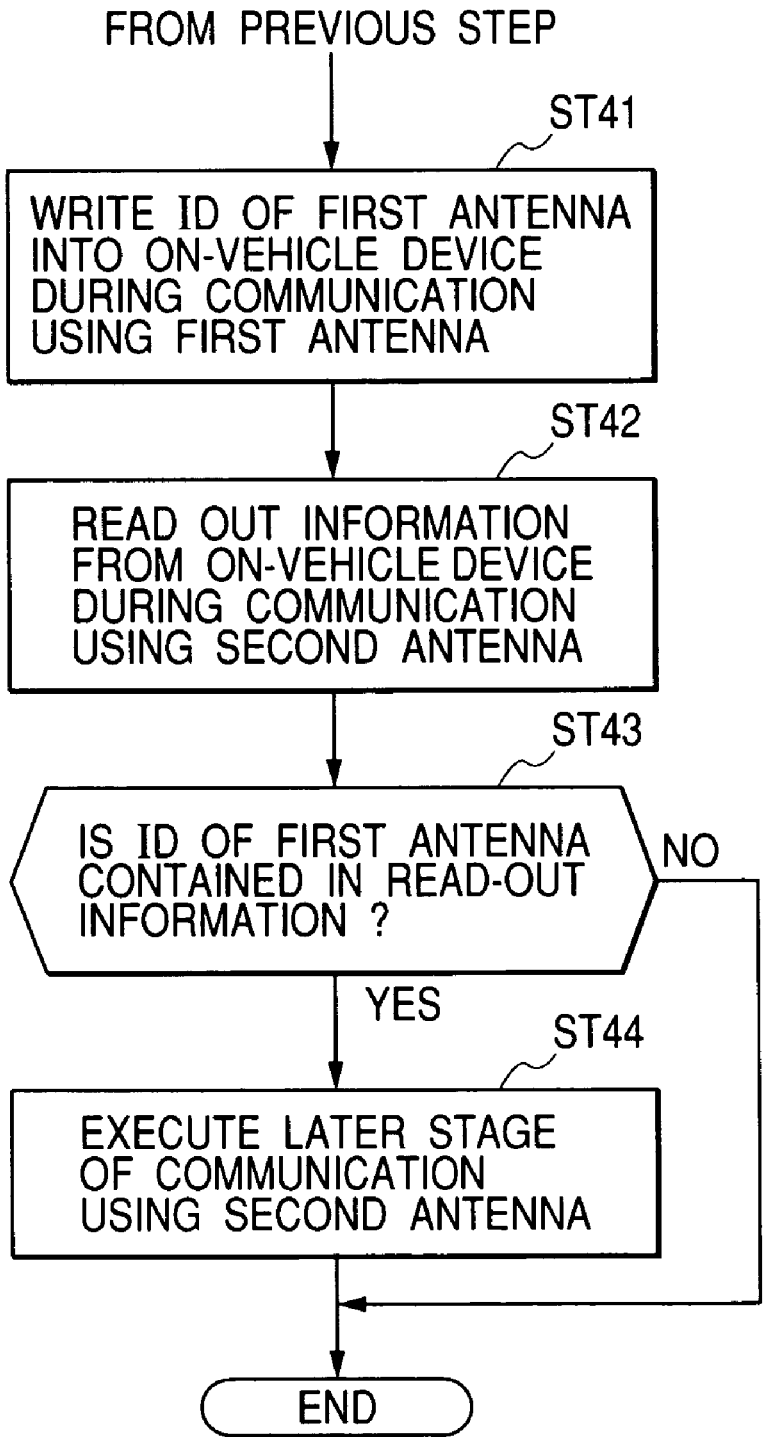
FIG. 25 is a flowchart of a segment of a program for a computer in an ETC system according to a seventh embodiment of this invention.

FIG. 25 shows a segment of the program for the control apparatus 114C (the computer 150C) in the seventh embodiment of this invention. With reference to FIG. 25, the program segment includes a step ST41 executed during radio communications with an on-vehicle device via the first road-side radio communication unit 113. The step ST41 accesses a memory within the on-vehicle device via the road-side radio communication unit 113, and writes ID (identification) information of the first road-side antenna 110 into the accessed memory.

A step ST42 following the step ST41 is executed during radio communications with an on-vehicle device via the second road-side radio communication unit 154. The step ST42 accesses a memory within the on-vehicle device via the second road-side radio communication unit 154, and reads out the latest written information from the accessed memory.

A step ST43 subsequent to the step ST42 decides whether or not the ID information of the first road-side antenna 110 is contained in the read-out latest written information. When the ID information of the first road-side antenna 110 is contained in the read-out latest written information, the step ST43 determines that the vehicle in question is of the ETC type traveling along the present lane and differs from an ETC vehicle in a lane adjacent to the present lane. In this case, the step ST43 sets a vehicle-related flag to a state representing that the vehicle in question is of the ETC type traveling along the present lane. Then, the program advances from the step ST43 to a step ST44. On the other hand, when the ID information of the first road-side antenna 110 is absent from the read-out latest written information, the step ST43 determines that the vehicle in question differs from an ETC vehicle traveling along the present lane. In this case, the step ST43 sets the vehicle-related flag to a state representing that the vehicle in question is not of the ETC type traveling along the present lane. Then, the program exits from the step ST43 and then the current execution cycle of the program segment ends.

The step ST44 implements a remaining stage of the radio communications with the on-vehicle device via the second road-side radio communication unit 154. The step ST44 may execute a given communication process such as a process of rewriting vehicle-type information. After the step ST44, the current execution cycle of the program segment ends.

Preferably, with respect to the standard radio-communication service area 118, constructions such as a roof and a gantry are coated with members for absorbing radio waves or members for preventing reflection of radio waves. On the other hand, with respect to the second radio-communication service area 119, it is unnecessary to coat constructions with members for absorbing radio waves or members for preventing reflection of radio waves.

What is claimed is:

1. An electronic toll collection system for a toll road which collects a toll from a vehicle passing a quasi communication area and reaching a standard communication area, comprising:

a road-side device;

first means, provided in the road-side device, for transmitting a polling signal, the polling signal at the quasi communication area having an electric field strength between a first electric field strength and a second electric field strength larger than the first electric field strength, the polling signal at the standard communication area having an electric field strength equal to or higher than the second electric field strength, an on-vehicle device of the vehicle positioned in the standard communication area being able to respond to the polling signal many times and to communicate with the road-side device;

second means, provided in the road-side device, for receiving a plurality of responses of a single on-vehicle device to the polling signal transmitted by the first means without receiving another signal in the on-vehicle device, the on-vehicle device being positioned in the standard communication area during the responses;

third means, provided in the road-side device for deciding whether or not the second means receives a response a plural number of times; and fourth means, provided in the road-side device, for deciding that the on-vehicle device is now positioned in the standard communication area when the third means decides that the second means receives the plurality of responses to the polling signal and starting a communication with the on-vehicle device positioned in the standard communication area.

2. An electronic toll collection system for a toll road which collects a toll from an vehicle passing a quasi communication area and reaching a standard communication area, comprising:

a first vehicle sensor for detecting a portion of the vehicle at fist position of the standard communication area on a lane when an on-vehicle device of the vehicle is placed in the standard communication area or the quasi communication area;

a second vehicle sensor for detecting the portion of the vehicle at a second position of the standard communication area on the lane which is ahead of the first position when the on-vehicle device of the vehicle is placed in the standard communication area;

first means, provided in a road-side device, for starting continuously transmitting a polling signal when the first vehicle sensor detects a vehicle, an electric field strength of the polling signal at the quasi communication area being between a first electric field strength and a second electric field strength larger than the first electric field strength, the electric field strength of the polling signal at the standard communication area being equal to or higher than the second electric field strength, the on-vehicle device of the vehicle placed in the standard communication area being able to communicate with the road-side device;

second means, provided in the road-side device, for receiving a response of an on-vehicle device of the vehicle to the polling signal transmitted by the first means; and third means, provided in the road-side device, for, after the second means receives the response, deciding whether or not both the first and second vehicle sensors detect the vehicle, deciding that the on-vehicle device is now placed in the standard communication area when both the first and second vehicle sensors detect the vehicle, and starting a communication with the on-vehicle device placed in the standard communication area.

3. An ETC system as recited in claim 2, wherein the second vehicle sensor is spaced from the first vehicle sensor at an interval of about 80 cm.

4. An electronic toll collection system for a toll road, comprising:

an on-vehicle device:

first means, provided in the on-vehicle device, for receiving data from a road-side device;

second means, provided in the on-vehicle device, for receiving a communication end signal representing an end of transmission of the data when the communication end signal transmitted from the road-side device reaches the on-vehicle device after the first means receives the data therefrom, handling the data received by the first means as effective data in response to the reception of the communication end signal, and ending a communication with the road-side device; and third means, provided in the on-vehicle device, for handling the data received by the first means as effective data when the second means does not receive the communication end signal, and ending a communication with the road-side device.

5. An ETC system as recited in claim 4, further comprising means provided in the road-side device for transmitting the communication end signal a plural number of times.

6. An electronic toll collection system for a toll road, comprising:

a road-side device:

first means, provided in the road-side device, for receiving data from an on-vehicle device;

second means, provided in the road-side device, for receiving a communication end signal representing an end of transmission of the data when the communication end signal transmitted from the on-vehicle device reaches the road-side device after the first means receives the data therefrom, handling the data received by the first means as effective data in response to the reception of the communication end signal, and ending a communication with the on-vehicle device; and third means, provided in the road-side device, for handling the data received by the first means as effective data when the second means does not receive the communication end signal, and ending a communication with the on-vehicle device.

7. An ETC system as recited in claim 6, further comprising means provided in the on-vehicle side device for transmitting the communication end signal a plural number of times.

8. A method of collecting a toll from a vehicle passing a quasi communication area and reaching a standard communication area in an electronic toll collection system for a toll road, comprising the steps of:

transmitting a polling signal from a road-side device, the polling signal at the quasi communication area having an electric field strength between a first electric field strength and a second electric field strength larger than the first electric field strength, the polling signal at the standard communication area having an electric field strength equal to or higher than the second electric field strength, an on-vehicle device of the vehicle positioned in the standard communication area being able to respond to the polling signal many times and to communicate with the road-side device;

enabling the road-side device to receive a plurality of responses of a single on-vehicle device of the vehicle to the polling signal without receiving another signal in the on-vehicle device, the on-vehicle device being positioned in the standard communication area during the responses;

deciding whether or not the road-side device receives a response a plural number of times;

deciding that the on-vehicle device is now positioned in the standard communication area when it is decided that the road-side device receives the plurality of responses to the polling signal; and enabling the road-side device to start communicating with the on-vehicle device positioned in the standard communication area.

9. A method of collecting a toll from a vehicle passing a quasi communication area and reaching a standard communication area in an electronic toll collection system for a toll road, comprising:

detecting a portion of a vehicle at a fist position of the standard communication area on a lane when an on-vehicle device of the vehicle is placed in the standard communication area or the quasi communication area;

detecting the portion of the vehicle at a second position of the standard communication area on the lane which is ahead of the first position when the on-vehicle device of the vehicle is placed in the standard communication area;

starting a continuous transmission of a polling signal when a vehicle at the first position is detected, an electric field strength of the polling signal at the quasi communication area being between a first electric field strength and a second electric field strength larger than the first electric field strength, the electric field strength of the polling signal at the standard communication area being equal to or higher than the second electric field strength, the on-vehicle device of the vehicle placed in the standard communication area being able to communicate with a road-side device;

receiving a response of an on-vehicle device of the vehicle to the polling signal; and after the response is received, deciding whether or not both the first and second vehicle sensors detect the vehicle;

deciding that the on-vehicle device is now placed in the standard communication area when both the first and second vehicle sensors detect the vehicle;

starting a communication with the on-vehicle device placed in the standard communication area.

10. A method in an electronic toll collection system for a toll road, comprising the steps of:

receiving data from a road-side device;

receiving a communication end signal representing an end of transmission of the data from the road-side device after the data are received therefrom;

handling the data received by the first means as effective data in response to the reception of the communication end signal;

handling the received data as effective data when no communication end signal is successfully; and ending a communication with the road-side device.

11. An on-vehicle device in an electronic toll collection system for a toll road, comprising:

first means for receiving data from a road-side device;

second means for receiving a communication end signal representing an end of transmission of the data when the communication end signal transmitted from the road-side device reaches the on-vehicle device after the first means receives the data therefrom, handling the data received by the first means as effective data in response to the reception of the communication end signal, and ending a communication with the road-side device; and third means for handling the data received by the first means as effective data when the second means does not receive the communication end signal, and ending a communication with the road-side device.

12. The system as recited in claim 1, wherein the fourth means implements an accounting process for the on-vehicle device in the radio communications.

13. The system as recited in claim 1, wherein the second means receives the plurality of responses without transmitting any signal to the on-vehicle device during the reception of the responses, and the fourth means starts the next radio communications with the on-vehicle device when the third means decides that the second means receives the responses without transmitting any signal to the on-vehicle device during the reception of the responses.

14. The system as recited in claim 2, wherein the third means implements an accounting process for the on-vehicle device in the radio communications.

15. The system as recited in claim 4, wherein the third means ends communication with the road-side device after handling the data as the effective data.

16. The system as recited in claim 6, wherein the third means ends communication with the on-vehicle device after handling the data as the effective data.

17. The method as recited in claim 8, wherein the step of enabling the road-side device to start the next radio communications includes implementing an accounting process for the on-vehicle device in the radio communications.

18. The method as recited in claim 8, wherein the step of enabling the road-side device to receive the plurality of responses includes enabling the road-side device to receive the plurality of responses without transmitting any signal to the on-vehicle device during the reception of the responses, and the step of enabling the road-side device to start the next radio communications includes enabling the road-side device to start the next radio communications with the on-vehicle device when it is decided that the road-side device receives the responses without transmitting any signal to the on-vehicle device during the reception of the responses.

19. The method as recited in claim 9, wherein the step of starting next radio communications includes implementing an accounting process for the on-vehicle device in the radio communications.

20. The method as recited in claim 10, further comprising a step of ending communication with the on-vehicle device after handling the received data as the effective data.

21. The device as recited in claim 11, wherein the third means ends communication with the road-side device after handling the data as the effective data.

* * * * *

UNITED STATES PATENT AND TRADEMARK OFFICE

CERTIFICATE OF CORRECTION

PATENT NO. : 7,353,185 B2
APPLICATION NO. : 09/864235
DATED : April 1, 2008
INVENTOR(S) : Seiji Fuyama It is certified that error appears in the above-identified patent and that said Letters Patent is hereby corrected as shown below:

Column 21, line 36, delete “fist” and insert therefor --first--.

Column 23, line 20, delete “fist” and insert therefor --first--.

Column 23, line 60, after “successfully” insert --received--.

Signed and Sealed this

Fourth Day of November, 2008

JON W. DUDAS
*Director of the United States Patent and Trademark Office*